US006932456B2

(12) United States Patent
Kanaya et al.

(10) Patent No.: US 6,932,456 B2
(45) Date of Patent: Aug. 23, 2005

(54) FLUSHING POSITION CONTROLLER INCORPORATED IN INK-JET RECORDING APPARATUS AND FLUSHING METHOD USED FOR THE SAME

(75) Inventors: Munehide Kanaya, Nagano (JP); Kazuhiko Hara, Nagano (JP); Shigenori Fukasawa, Nagano (JP); Atsushi Kobayashi, Nagano (JP); Kazunaga Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/624,610

(22) Filed: Jul. 23, 2003

(65) Prior Publication Data

US 2004/0085391 A1 May 6, 2004

Related U.S. Application Data

(63) Continuation of application No. 09/747,930, filed on Dec. 27, 2000, now Pat. No. 6,619,783, which is a continuation-in-part of application No. 09/443,299, filed on Nov. 19, 1999, now abandoned.

(30) Foreign Application Priority Data

| | | |
|---|---|---|
| Nov. 20, 1998 | (JP) | P. 10-331026 |
| Nov. 27, 1998 | (JP) | P. 10-338015 |
| Dec. 2, 1998 | (JP) | P. 10-343079 |
| Dec. 17, 1998 | (JP) | P. 10-359068 |
| Mar. 29, 1999 | (JP) | P. 11-086921 |
| Dec. 27, 1999 | (JP) | P. 11-371179 |

(51) Int. Cl.[7] ..... B41J 2/165
(52) U.S. Cl. ..... 347/29; 347/35
(58) Field of Search ..... 347/22, 29, 30, 347/33, 35

(56) References Cited

U.S. PATENT DOCUMENTS

| | | | |
|---|---|---|---|
| 5,717,445 | A | 2/1998 | Kida et al. |
| 5,726,692 | A | 3/1998 | Yamaguchi et al. |
| 5,793,388 | A | 8/1998 | Martinson et al. |
| 5,896,143 | A | 4/1999 | Matsui et al. |
| 5,997,128 | A | 12/1999 | Lou et al. |
| 6,257,696 | B1 | 7/2001 | Nakamura |
| 6,312,089 | B1 | 11/2001 | Imai |

FOREIGN PATENT DOCUMENTS

| | | |
|---|---|---|
| EP | 0 744 294 A1 | 11/1996 |
| JP | 403227658 A | 10/1991 |
| JP | 10-76677 | 3/1998 |

*Primary Examiner*—Shih-Wen Hsieh
(74) *Attorney, Agent, or Firm*—Sughrue Mion, PLLC

(57) ABSTRACT

Flushing regions for receiving ink droplets to be ejected when flushing signal is supplied to a recording head are provided in both of non-print regions situated at both sides of print region in order to prevent throughput during the flushing operation from deteriorating. A guide member having a slant surface is disposed between the recording head and an ink absorbing member to which the ink landed on the slant surface flows in order to reduce in size of the ink absorbing member. A porous sheet member closely faced to nozzle orifices of the recording head for receiving the ink droplets ejected therefrom is provided in order to prevent undesired mist of fine ink droplets from generating. A plurality of plate members closely faced to the nozzle orifices are provided at a predetermined angle with respect to the flight direction of the ink droplets in order to prevent the undesired mist from generating. The flushing operation is performed so as to prevent solidification of the ejected ink.

10 Claims, 20 Drawing Sheets

FLUSHING POSITION CONTROLLER INCORPORATED IN INK-JET RECORDING APPARATUS AND FLUSHING METHOD USED FOR THE SAME

CROSS-REFERENCE TO RELATED APPLICATION

This is a continuation application of U.S. patent application No. 09/747,930 filed Dec. 27, 2000 now U.S. Pat. No. 6,619,783, which application was a continuation-in-part of U.S. patent application No. 09/443,299 filed Nov. 19, 1999 now abandoned, the disclosure of both previous applications being incorporated in full herein by reference.

BACKGROUND OF THE INVENTION

The present invention relates to a flushing position controller incorporated in an ink-jet recording apparatus and a flushing method used for the same. More particularly, the present invention relates to an ink-jet recording apparatus comprising an ink-jet recording head which is mounted on a carriage so as to travel in the widthwise direction of recording paper and which forms an image on a recording medium by ejecting jets of ink droplets via nozzle orifices, and a flushing region provided on the path along which the recording head travels for receiving ink droplets to be jetted when a flushing drive signal is supplied to the recording head; a flushing method for use with such an ink-jet recording apparatus; and a flushing position controller for use with the ink-jet recording apparatus.

Ink-jet recording apparatus can print small dots at a comparatively low noise level at high density, and hence they have recently been used in many printing applications, including color printing.

Such an ink-jet recording apparatus comprises an ink-jet recording head which receives ink supplied from an ink cartridge, and a paper feeder for feeding recording paper relative to the recording head. Text or an image is recorded on the recording paper by causing the recording head to eject ink droplets toward the recording paper while the recording head travels together with a carriage in the widthwise direction of the recording paper.

For example, a black recording head for ejecting black ink and a color recording head capable of ejecting various colors of ink, such as yellow, cyan, and magenta, are mounted on a single recording head. The ink-jet recording apparatus enables full-color printing through use of black ink and other colors of ink, as well as printing of text, by means of changing the proportions of color inks to be ejected.

Such an ink-jet recording head performs a printing operation by ejecting ink, which is pressurized in a pressure generating chamber, in the form of ink droplets by way of nozzles. The ink-jet recording head suffers problems such as printing failures, which are caused by an increase in the viscosity of ink due to evaporation of a solvent by way of nozzle orifices, solidification of ink, adhesion of dirt or dust to the nozzles, or mixing of air bubbles into ink.

In order to prevent the printing failures, the ink-jet recording apparatus is equipped with a capping member for sealing the nozzle orifices of the recording head while the recording apparatus is in a non-printing mode, and a cleaning device for cleaning a nozzle plate, as required.

The capping member acts as a cap for preventing ink from being dried by way of the nozzle orifices while the recording apparatus is in a non-printing mode. Further, in the event that the nozzle orifices become clogged, the capping member seals the nozzle plate and eliminates clogging in the nozzle orifices caused by solidification of ink or an ink ejecting failure caused by mixing of air bubbles into the ink flow channel, by suctioning ink by way of the nozzle orifices and by means of negative pressure imparted by a suction pump.

Forced discharging operation, which is performed in order to eliminate clogging in the recording head or air bubbles mixed into the ink flow channel, is usually called cleaning operation. The cleaning operation is performed when a printing operation is resumed after the recording apparatus has remained in an idle mode for a long period of time or when the user actuates a cleaning switch for eliminating degradation in the quality of a recorded image. The cleaning operation involves removal of ink droplets from the recording head by means of negative pressure applied through suction, and wiping of the surface of the recording head by means of a wiping blade formed from rubber or an elastic plate.

The capping member also has a capability of ejecting ink droplets by application to the recording head of a drive signal that is irrelevant to printing. This function is usually called flushing operation. The flushing operation is performed at predetermined cycles for the purposes of: recovering meniscuses, which are formed irregularly in the vicinity of nozzle orifices of the recording head as a result of wiping action of the wiping blade during the cleaning operation; discharging mixed ink which has flowed back from the nozzles as a result of wiping operation; and preventing clogging in the nozzle orifices from which a small amount of ink droplets is ejected during a printing operation, which would otherwise be caused by an increase in the viscosity of ink.

The schematic configuration of an ink-jet recording apparatus capable of effecting a flushing operation and a cleaning operation such as those mentioned previously will now be described by reference to FIG. 23.

In FIG. 23, reference numeral 1 designates a carriage. The carriage 1 is configured so as to travel back and forth along a carriage shaft 4 which is horizontally supported by side frames 2 and 3, by way of movement of a timing belt driven by an unillustrated carriage motor.

An ink-jet recording head 5 is mounted on the carriage 1 so as to face downward, and a black ink cartridge 6 for supplying black ink to the recording head 5 and a color ink cartridge 7 are removably mounted on the top of the carriage 1.

A paper guide member 8 is situated below the recording head 5 and extends in the same direction as that in which the recording head 5 scans, and recording paper 9 serving as a recording medium is placed on the paper guide member 8. The recording paper 9 is fed in the direction orthogonal to the scanning direction of the recording head 5, by means of an unillustrated paper feeder.

Reference numeral 10 designates a capping member disposed in a non-print region (i.e., the home position). When the recording head 5 has moved to a position immediately above the non-print region, the capping member 10 can seal a nozzle plate serving as a nozzle forming surface of the recording head 5.

A suction pump 11 is disposed below the capping member 10 so as to impart negative pressure to the interior space of the capping member 10.

The capping member 10 acts as a cap for preventing drying of the nozzle orifices of the recording head 5 while the ink-jet recording apparatus is in a non-print mode, and as a member for sucking ink by imparting negative pressure supplied from the suction pump 11 to the recording head 5.

A wiping member 12 formed from rubber or an elastic plate is provided in the vicinity of the capping member 10. When the carriage 1 travels back and forth toward the capping member 10, the wiping member 12 wipes a nozzle forming surface of the recording head 5.

A flushing region 13A is provided in another non-print region which is located opposite the non-print region where the capping member 10 is provided, with a center print region located therebetween.

The flushing region 13A is defined by an aperture 13*a* formed in the paper guide member 8.

An ink-absorbing member 14 is disposed behind the aperture 13*a* (or on the inner bottom of the recording apparatus) and doubles as a member for absorbing and retaining the ink discharged by the suction pump 11 from the interior space of the capping member 10. The ink-absorbing member 14 is housed in an ink-absorbing material housing case disposed along the paper guide member 8; i.e., a waste-ink tank 15.

In the recording apparatus, nozzles are periodically flushed in order to prevent ejecting failures, which would otherwise be caused by an increase in the viscosity of ink remaining in the nozzles which are not used during the printing operation.

Particularly, a recent large-scale model of the ink-jet recording apparatus performs flushing of ink at an average rate of several tens of droplets per nozzle every several seconds.

After a cleaning operation, at the beginning of a printing operation, or periodically during a printing operation, thousands of droplets or even tens of thousands of droplets of ink may be ejected.

The recording head may be flushed within the capping member 10 or in the flushing region 13A constituted of the aperture formed in the paper guide member 8.

Particularly, the recording head is flushed within the flushing region in order to prevent an overflow of ink, which would otherwise be caused when ink droplets are continuously ejected after the capping member 10 has already been filled with ink.

As mentioned above, the related ink-jet recording apparatus is required to temporarily suspend a printing operation in order to flush the recording head, move the carriage to the capping member or the flushing region, return the carriage to the position where the printing operation was interrupted, after flushing of the recording head is completed, and resume the printing operation.

Because of these requirements, the related recording apparatus encounters technological problems; i.e., a deterioration in throughput associated with the flushing operation; and an increase in print time.

If the recording head is to be flushed while situated at the non-print region opposite the capping member, the carriage must temporarily travel to the capping member, thus considerably deteriorating throughput.

Since the ink-absorbing member receives ink ejected by the recording head, the ink-absorbing member must be placed in a position opposite the flushing region. However, in some cases the ink-absorbing member cannot be disposed opposite the flushing region, because of a limitation imposed by the layout of other components.

Further, there exists demand for a further reduction in the size of the ink-absorbing member in order to make the recording apparatus compact.

There has also been recently provided a model of ink-jet recording apparatus which is pre-installed with a sequence for flushing a recording head within a flushing region formed opposite the traveling direction of the carriage, without moving the recording head to the capping member in order to improve throughput.

A sequence for flushing a recording head in a flushing region other than the capping member is employed in a case where a time interval between required periodic flushing operations is short, where considerable time is required to move the carriage across paper of large size, or where the direction of printing is out of synchronism with the timing at which flushing is effected.

As shown in FIG. 23, if the aperture 13*a* is formed in the paper guide member 8 as the flushing region, the nozzle forming surface of the recording head 5 is spaced several centimeters away from the ink-absorbing member 14, thus inevitably involving an increase in the distance over which ink is to be ejected.

Some of ink droplets ejected from the nozzle orifices of the recording head turn into mist as a result of air resistance and are suspended in air before arrival at the ink-absorbing member 14, thus staining the surroundings.

Ink droplets ejected from the nozzle orifices are electrically charged to a considerably degree. The ink droplets are affected by the electrostatic charge developed in a drive section of the recording apparatus and are accelerated by an air flow induced by an exhaust fan disposed for preventing an increase in the internal temperature of the recording apparatus or an air flow resulting from movement of the carriage, thus staining as well the (external) area surrounding the recording apparatus.

In a recent recording apparatus which controls the quantity of single ink droplets so as to form the smallest-possible ink droplets in order to implement high picture quality, the foregoing problems become more pronounced.

A conceivable measure for preventing the problems is to place waste-fluid absorbing material in proximity to the recording head. However, a mechanism, such as a paper feed roller, is usually disposed in an area within a range of carriage travel facing the head, thus making it difficult to ensure a sufficient capacity for the mechanism. Further, the waste-fluid absorbing material is selected so as to have higher capability of absorbing a waste-fluid (i.e., ink). Therefore, if ink droplets are sprayed directly onto the waste-fluid absorbing material during flushing operation, the waste-fluid absorbing material is susceptible to clogging. Further, such a waste-fluid absorbing material is slow to absorb ink.

To solve such a problem, the present inventors of the invention proposed that a slant member for guiding the ejected ink into the ink-absorbing member 14 be interposed between the aperture 13*a* formed in the paper guide member 8 and the ink-absorbing member 14.

Even in this case, the ink ejected from the recording head 5 tends to solidify on the surface of the slant member, thus raising the new technical problems of the thus-solidified ink hindering the flow of ink and the smooth introduction of ink toward the ink-absorbing member 14.

Particularly, black ink is given a high solid content in order to increase the thickness of a character and has a property of being susceptible to an increase in viscosity and is likely to solidify when solvent contained in the ink has evaporated.

The black ink solidified on the slant surface hinders flow of black ink ejected subsequent to the solidified black ink, or flow of ink of another color.

Even if the slant member is not provided, black ink solidified within the ink-absorbing member hinders absorption of black ink ejected subsequent to the solidified black ink, or absorption of ink of another color.

Recently, an ink-jet recording apparatus has been required to have capability of producing a large volume of printed matter at high speed.

In order to meet this demand, a large amount of ink must be ejected during the cleaning and flushing operations performed for recovering the print capability of the recording head. Therefore, a large amount of waste ink cannot be discharged by an ink-jet recording apparatus in which the capping member performs a cleaning operation in conjunction with a flushing operation.

To prevent this problem, there has already been seen an ink-jet recording apparatus which is provided with an area designated specifically for flushing operation and which performs a flushing operation in the designated area.

A processing routine employed for the flushing operation comprises a step of deactivating a carriage motor within a predetermined flushing region and flushing a recording head, and a step of performing a print operation. As mentioned above, such a processing routine encounters a difficulty in increasing throughput.

For example, in the case of an ink-jet recording apparatus comprising a plurality of recording heads provided on a carriage, wherein the respective recording heads perform printing operation while traveling in the direction of their arrangement in a row, there must be ensured a flushing region whose width is equal to or greater than the width of the plurality of recording heads in the traveling direction of the carriage. Thus, the ink-jet recording apparatus cannot elude a further increase in size.

SUMMARY OF THE INVENTION

In view of the above, a first object of the present invention is to provide an ink-jet recording apparatus capable of preventing a decrease in throughput, which would otherwise be caused by a flushing operation.

A second object of the present invention is to provide an ink-jet recording apparatus which can solve the previously-described problem and receive the ink ejected by a recording head without requiring placement of an ink-absorbing member at a position opposite the flushing region.

A third object of the present invention is to provide an ink-jet recording apparatus capable of effectively preventing generation of mist, which would otherwise be suspended in the form of minute droplets particularly during flushing operation; in other words, an ink-jet recording apparatus which has great commercial value and prevents staining of the inside or outside of the recording apparatus.

A fourth object of the present invention is to provide an ink-jet recording apparatus which prevents solidification of the ink ejected from a recording head, which would otherwise hinder the absorption of ink by an ink-absorbing member.

A fifth object of the present invention is to provide an ink-jet recording apparatus which solves the above-described problem by flushing recording heads within a flushing region at timings corresponding to the respective recording heads while the carriage is traveling.

A sixth object of the present invention is to provide a recording apparatus which comprises means by way of which a adjusting value for controlling the flushing timings is input and which can accurately flush the recording heads within the flushing region.

In order to achieve the above objects, according to the present invention, there is provided An ink-jet recording apparatus comprising:

an ink-jet recording head mounted on a carriage which travels in the widthwise direction of a recording medium for recording an image thereon by ejecting ink droplets from nozzle orifices provided therewith;

a flushing region situated on the traveling path of the carriage in at least one of non-print regions which are arranged both sides of a print region, the flushing region including an ink absorbing member for receiving ink droplets ejected from the recording head when a flushing operation is performed;

capping means provided in one of the non-print regions for sealing the nozzle orifices; and a guide member disposed in the flushing region and having a slant surface on which the ink droplets land and flow toward the ink absorbing member.

By means of the slant member, after the ink ejected from the nozzle orifices of the recording head has adhered to the slant surface of the slant member, the ink is guided to the ink-absorbing member.

Consequently, there is no necessity for locating the ink-absorbing member opposite the flushing region, thus contributing an increase in the degree of freedom in laying out other components. Further, since the ink-absorbing material can be made compact, the ink-jet recording apparatus can be made more compact.

Preferably, the flushing region includes a plate member provided with an aperture though which the ink droplets pass. The aperture is situated between the recording head and the guide member.

The aperture prevents splashing of ink ejected from the nozzle orifices of the recording head.

More preferably, the respective apertures are larger than a size of surface on which the nozzle orifices are formed.

The ink ejected from the nozzle orifices of the recording head can be completely absorbed by the ink-absorbing material by way of the aperture without splashing.

Preferably, an extending direction of the slant surface is arbitrarily selected with respect to the traveling direction of the carriage.

Consequently, there is no necessity for locating the ink-absorbing member opposite the flushing region, thus contributing to an increase in the degree of freedom in laying out other components.

In some cases, ink adheres to the slant surface as the slant angle $\theta$ of the slant surface approaches 0° and fails to drop toward the ink-absorbing material. For this reason, the slant angle $\theta$ of the slant surface is desirably set to an angle of more than 0°.

As the slant angle $\theta$ of the slant surface approaches 90°, the ink-absorbing material cannot be made compact. Hence, the ink-absorbing material must be disposed opposite the flushing region. For this reason, the slant angle $\theta$ of the slant surface is desirably set to an angle of less than 60°

Hence, preferably, a slant angle of the slant surface is set within a domain of $30° < \theta < 60°$.

Preferably, a water-repellent layer is formed on the slant surface.

Accordingly, the ink adhering to the slant surface is likely to drop toward the ink-absorbing member in the form of an ink droplet, thus preventing solidification of the ink adhering to the slant surface.

Further, formation of the water-repellent layer enables a further decrease in the slant angle θ of the slant surface. Consequently, the slant member can be made more compact.

Preferably, the recording head ejects a plurality colors of ink such that ink, which is easier to accumulate on the slant surface, lands on a lower position of the slant surface.

Even when such ink to be ejected from the nozzle orifices corresponding to a lower portion of the slant surface is likely to adhere thereto, as a result of dropping of ink having lower viscosity that has adhered to the upper portion of the slant surface and that is less likely to solidify, and is absorbed by the ink-absorbing material.

More preferably, a landing position of black ink is lower than landing positions of any other colors of ink.

Preferably, the guide member is provided as a plurality of plate members for receiving the ink droplets at a predetermined angle with respect to a flight direction of the ink droplets.

More preferably, the plural plate members are arranged within a cylindrical casing at substantially equal intervals and at the predetermined angle.

More preferably, a cylindrical guide body is extended from the cylindrical casing continuously and downwardly for leading the received ink to the ink absorbing member.

More preferably, the predetermined angle is set within a domain of 40 to 80 degrees.

In the above configurations, the ink droplets ejected from the recording head within the flushing region are captured by any one of the plurality of plate members disposed at a predetermined angle with respect to the direction of flight of the ink droplets.

The waste ink captured by the plate members is guided to the waste-ink tank disposed below the plate members (i.e., in the downward direction).

The distance over which the ink droplets are to fly can be reduced by setting to a small value the angle formed between the direction of flight of ink droplets and the orientation of the plate members, thus diminishing the extent to which a mist is produced. However, the angle at which ink droplets impinge on the surface of the plate members becomes close to a normal, thus generating a mist when the plate members cause the ink droplets to splash.

In contrast, if the angle formed between the direction of flight of ink droplets and the orientation of the plate members is set to a large value, the mean distance over which ink droplets are to fly becomes greater, thus generating a mist to a large extent.

For these reasons, the angle formed between the direction of flight of ink droplets and the orientation of the plate members is desirably set to an angle of about 60°. Consequently, the extent to which the mist is generated can be diminished, thus preventing contamination of interior or exterior of the ink-jet recording apparatus.

Preferably, the flushing region is situated each of the non-print regions.

In the above configuration, at the time of flushing of the recording head, the carriage is moved to the closer of the two flushing regions, where the recording head then ejects ink.

Since the flushing region is provided also in the area opposite the capping member, a necessity for flushing the recording head by returning the carriage to the capping member can be eliminated as well.

Consequently, throughput associated with flushing operation is improved, and a print time can be shortened.

Preferably, the flushing operation includes a first flushing for ejecting ink droplets of a first ink and a second flushing for ejecting ink droplets a second ink different from the first ink. The first flushing is performed at a first position in the flushing region, and the second flushing is performed at a second position of the flushing region.

Accordingly, cumulative deposition of ink can be prevented and ensuring absorption of ink by the ink-absorbing material.

Preferably, the first flushing and the second flushing is performed in order.

Preferably, the second flushing is performed without stopping the carriage.

Preferably, the first flushing is performed before the carriage starts to travel.

Preferably, the first flushing is performed without stopping the carriage.

If ink is ejected without the carriage being stopped, cumulative deposition of ink can be prevented, as mentioned above.

Preferably, the first position and the second position are fixed.

Alternatively, one of the first and second positions is fixed and the other is variable.

Preferably, the recording head includes three pairs of nozzle orifice arrays. A distance X between the first and second positions satisfies one of the following relationships:

$$L1-L2 \leqq X \leqq L1+L2, \text{ and}$$

$$2(L1-L2) \leqq X \leqq 2(L1+L2)$$

where L1 denotes a distance between the respective pairs of nozzle orifice arrays, and L2 denotes a distance between the respective nozzle orifice arrays.

Even when the carriage is stopped, the flushing method is particularly desirable because it can prevent cumulative deposition of ink by changing the first and second positions.

Preferably, the first position is situated at an outer traveling limit of the carriage, and a second position is situated where is closer to the print region than the first position.

More preferably, the first ink is black ink, and the second ink is at least one of cyan ink, magenta ink and yellow ink.

Alternatively, the first ink is at least one of cyan ink, magenta ink and yellow ink, and the second ink is black ink.

More preferably, the ink-jet recording apparatus further comprises a ventilation fan. The ventilation fan is halted during the flushing operation.

Accordingly, there can be prevented solidification of black ink on the slant surface, or otherwise hindering flow of black ink or ink of another color ejected later and flow of the ink to the ink-absorbing material.

As mentioned above, the black ink is susceptible to an increase in viscosity or solidification when the solvent of black ink evaporates. Even when the slant member is not provided, the flushing method of the present invention can prevent solidification of black ink within the ink-absorbing material, which would otherwise prevent absorption of black ink or ink of another color ejected later.

Preferably, the ink-jet recording apparatus further comprises a flushing position controller including means for inputting a value for adjusting a timing of outputting a flushing drive signal for triggering the flushing operation.

More preferably, the adjusting value is inputted as a first value for correcting a preset flushing position of one of the nozzle orifice of the recording head.

More preferably, the first correcting value is managed by counting reference pulses. A second correcting value for a preset flushing position of another nozzle orifice is managed by a delay time period from a flushing drive signal based on the first correcting value.

Alternatively, the first correcting value is managed by counting reference pulses. A second correcting value for a preset flushing position of another nozzle orifice is also managed by counting the reference pulses.

Preferably, the reference pulses is an encoder signal generated according to the traveling of the carriage.

More preferably, the ink-jet recording apparatus further comprises a non-volatile memory for storing the correcting values. The output timing of the flushing drive signal is determined with reference to the correcting values in the non-volatile memory and the encoder signal.

Preferably, the ink-jet recording apparatus further comprises a plate member provided with an aperture situated in the flushing region. The aperture is situated between the recording head and the guide member. The aperture is smaller than a size of surface on which the nozzle orifices are formed.

Preferably, the nozzle orifices form a plurality of nozzle rows in the recording head. The flushing position controller controls the flushing operation such that each nozzle row coming to a predetermined flushing position starts to eject ink drops.

More preferably, a nozzle row arranged further from the moving direction of the carriage when the flushing operation is performed is used for ejecting ink which requires less flushing operation.

More preferably, the flushing operation is performed when the carriage is accelerated.

Alternatively, the nozzle orifices form a plurality of nozzle rows in the recording head. The flushing position controller controls the flushing operation such that all nozzle rows ejects ink drops when the carriage starts to move.

More preferably, a nozzle row arranged further from the moving direction of the carriage when the flushing operation is performed is used for ejecting ink which requires less flushing operation.

Consequently, the throughput pertaining to flushing can be improved, and the width of the flushing region can be set to a smaller value, thus rendering the recording apparatus compact.

Furthermore, the accuracy of timing at which each of the recording heads ejects ink for flushing can be improved, and the ink droplets can be ejected within a narrower specified area, thus enabling a further reduction in the size of the flushing region.

According to the present invention, there is also provided an ink-jet recording apparatus comprising:

an ink-jet recording head mounted on a carriage which travels in the widthwise direction of a recording medium for recording an image thereon by ejecting ink droplets from nozzle orifices provided therewith; and a flushing region situated on the traveling path of the carriage in at least one of non-print regions which are arranged both sides of a print region, the flushing region including a porous sheet member for receiving ink droplets ejected from the recording head when a flushing operation is performed, and an ink absorbing member for absorbing ink received by the porous sheet member.

Preferably, a distance between the porous sheet member and a surface on which the nozzle orifices are formed is set within a domain of 1 to 5 mm when the flushing operation is performed.

Preferably, the porous sheet member is hydrophilic.

Preferably, a mean pore size of the porous sheet is set within a domain of 100 to 500 $\mu$m.

Preferably, the periphery of the porous sheet member is enclosed by a case. The ink ejected during flushing operation flows along the interior of the case and is absorbed by the ink absorbing member.

More preferably, a lower end of the porous sheet member contacts with an inner face of the casing.

More preferably, the lower end of the porous sheet member is partially notched such that an opening is defined by the notch and the inner face of the casing.

More preferably, the opening is situated so as not to face the nozzle forming surface when the flushing operation is performed.

Preferably, the porous sheet member is secured to the casing by a fixing member. The fixing member is situated so as not to face the nozzle forming surface when the flushing operation is performed.

In the above configurations, ink droplets ejected from the recording head within the flushing region during flushing operation are received by the porous sheet member disposed in proximity to and so as to face the recording head.

Since the porous sheet is disposed in close proximity to the recording head, substantially all the ink droplets or minute droplets ejected from the nozzle orifices fly to the porous sheet member, thus minimizing the chance of a portion of the ink droplets or minute droplets being suspended in the air in the form of a mist.

The ink droplets received by the porous sheet member are transferred to and absorbed by the waste-liquid absorbing material by way of the case retaining the porous sheet member.

Consequently, the present invention enables solving of a problem; i.e., staining of the interior or exterior of the ink-jet recording apparatus, which would otherwise be caused by the mist.

According to the present invention, there is also provided An ink-jet recording apparatus comprising:

a plurality of ink-jet recording heads mounted on a carriage which travels in the widthwise direction of a recording medium for recording an image thereon by ejecting ink droplets from nozzle orifices provided therewith;

a flushing region situated on the traveling path of the carriage in at least one of non-print regions which are arranged both sides of a print region, the flushing region for receiving ink droplets ejected from the moving recording head when a flushing operation is performed; and a flushing position controller including means for inputting a value for adjusting a timing of outputting a flushing drive signal for triggering the flushing operation.

In the above configuration, the throughput pertaining to flushing can be improved, and the width of the flushing region can be set to a smaller value, thus rendering the recording apparatus compact.

Furthermore, the accuracy of timing at which each of the recording heads ejects ink for flushing can be improved, and the ink droplets can be ejected within a narrower specified area, thus enabling a further reduction in the size of the flushing region.

BRIEF DESCRIPTION OF THE DRAWINGS

In the accompanying drawings:

FIGS. 9A and 9B show an ink receiver unit to be positioned in the flushing region of the ink-jet recording apparatus according to a third embodiment, wherein FIG. 9A is a front view showing the configuration of the ink receiver unit, and FIG. 9B is a longitudinal cross-sectional view of the same;

FIGS. 10A and 10B show an ink receiver unit to be positioned in the flushing region of the ink-jet recording apparatus according to a fourth embodiment, wherein FIG. 10A is a front view showing the configuration of the ink receiver unit, and FIG. 10B is a longitudinal cross-sectional view of the same;

DETAILED DESCRIPTION OF THE PREFERRED EMBODIMENTS

An ink-jet recording apparatus, a flushing method, and a flushing position controller according to the present invention will be described hereinbelow by reference to the accompanying drawings.

To start, an ink-jet recording apparatus according to a first embodiment of the present invention will now be described by reference to FIGS. 1 and 2.

Figure 1:
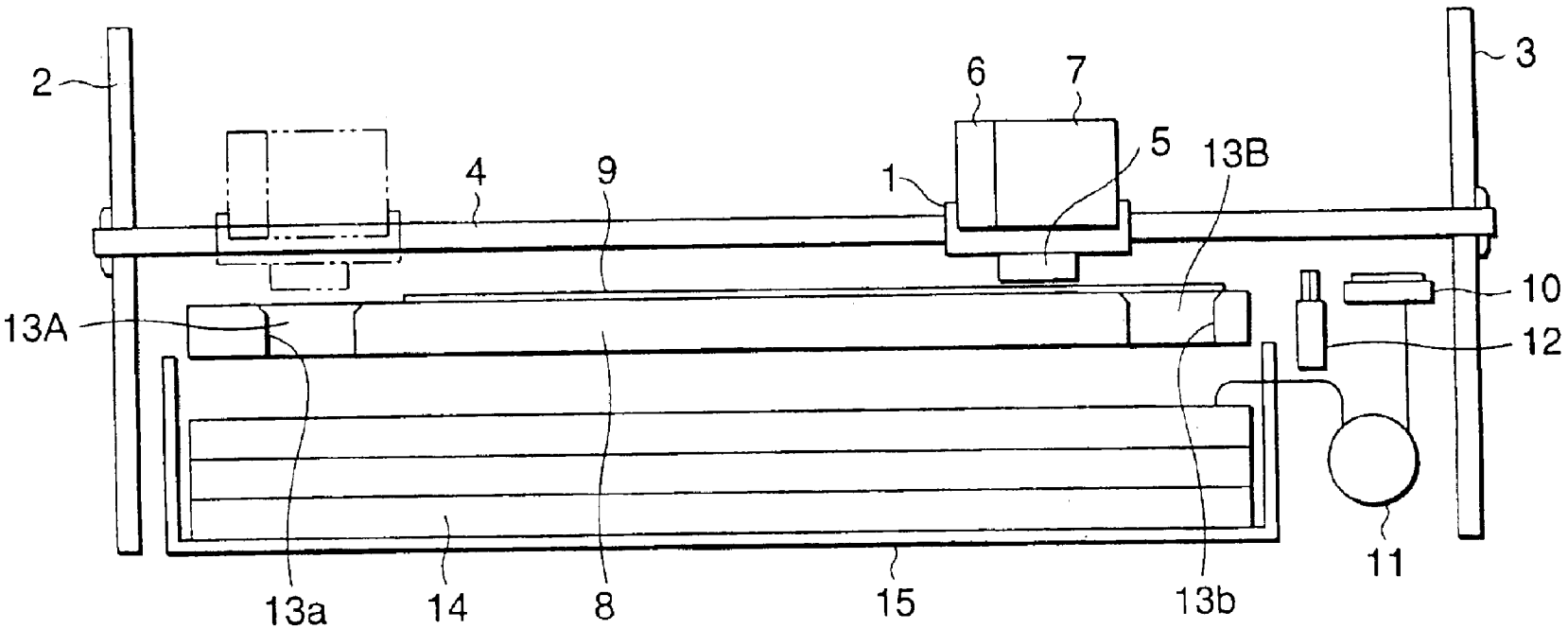
FIG. 1 is a front view showing a main unit of an ink-jet recording apparatus according to a first embodiment of the present invention, with a portion of the main unit being shown in cross section.
Figure 2:
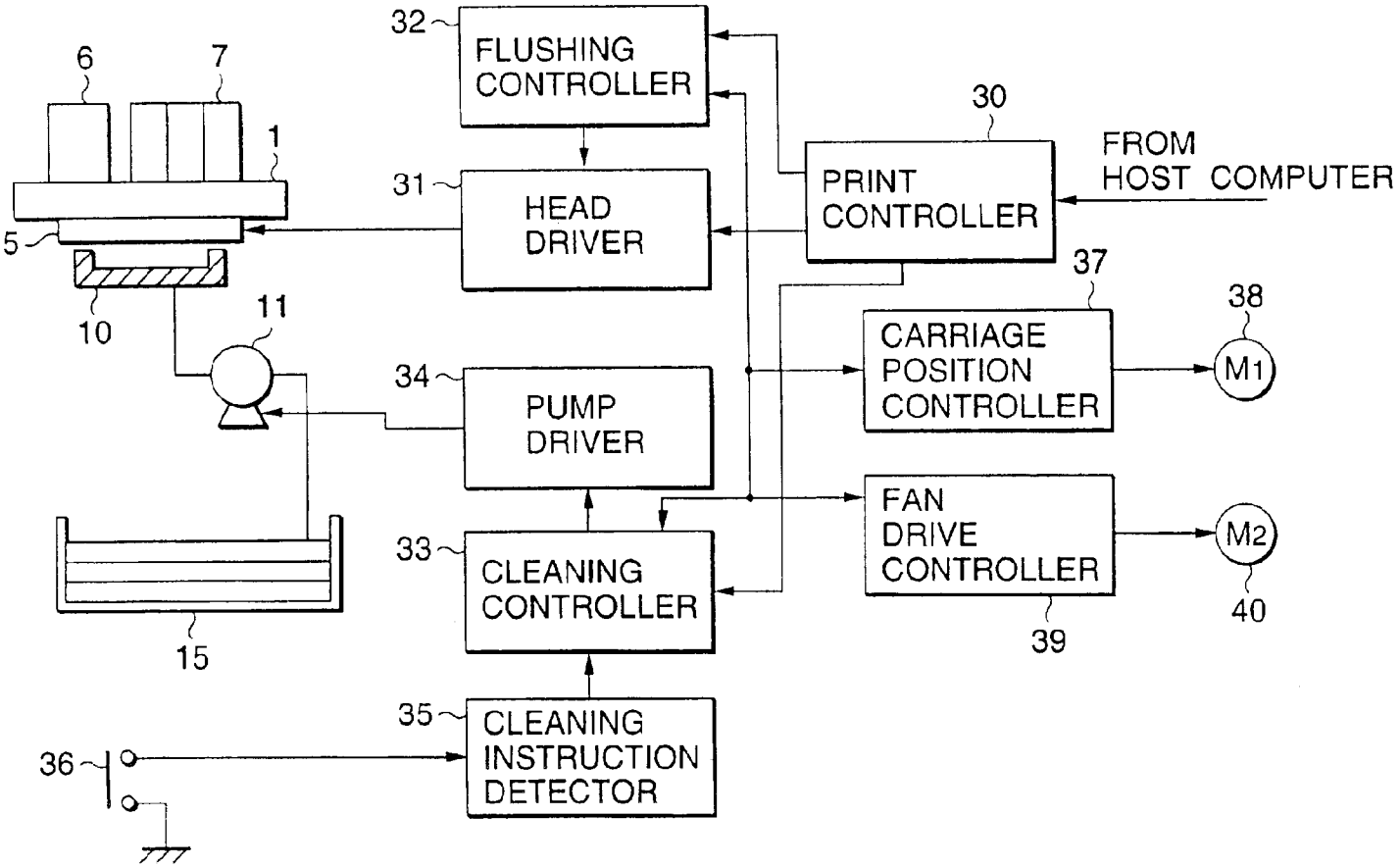
FIG. 2 is a block diagram showing one example of a control circuit provided in the ink-jet recording apparatus of the present invention.

FIG. 1 shows configuration of a main unit of an ink-jet recording apparatus according to a first embodiment of the present invention, and FIG. 2 shows an example of a control circuit provided in the recording apparatus.

Figure 19:
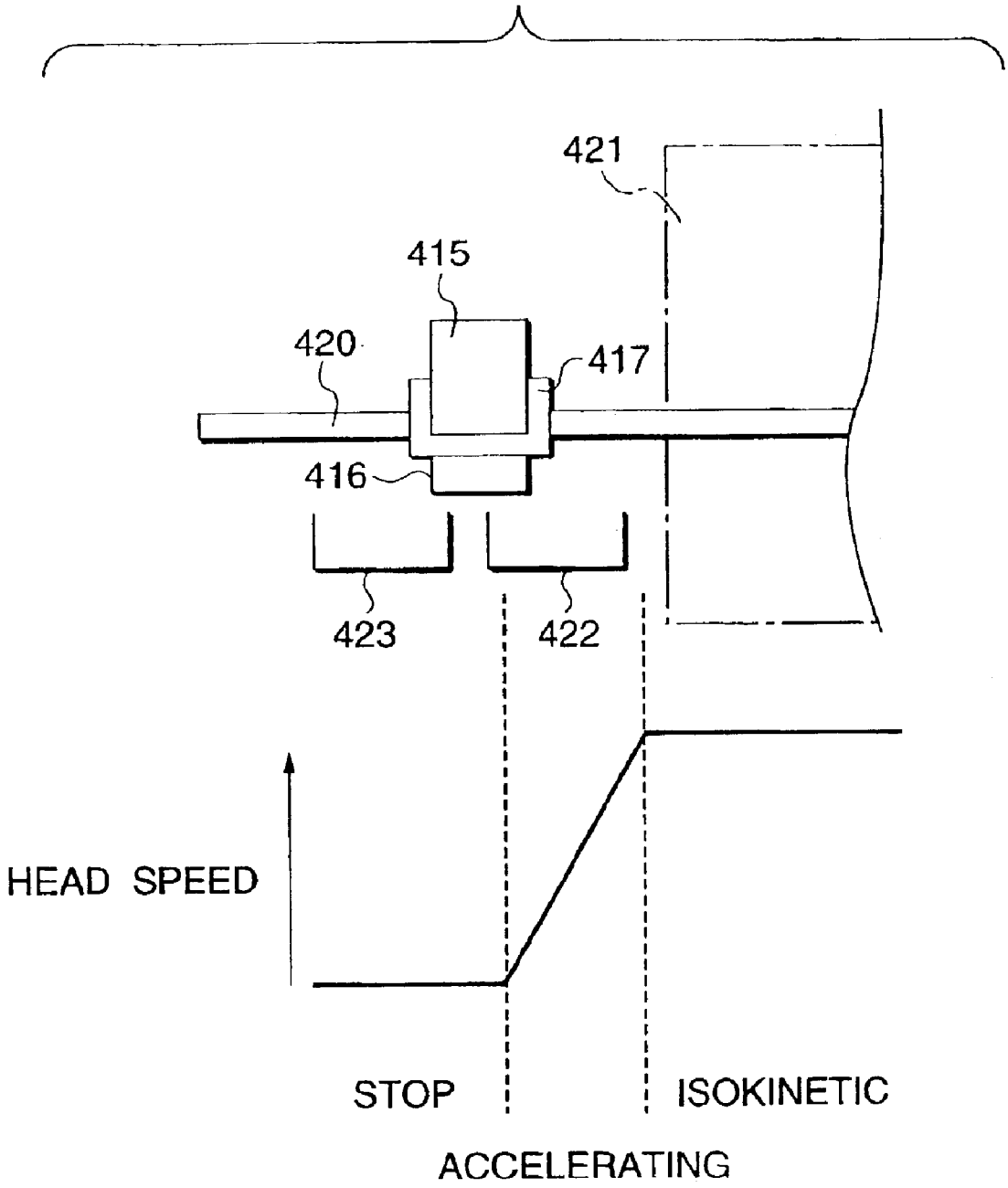
FIG. 19 is a schematic representation to show a main part of the ink jet recording apparatus according to a seventh embodiment of the invention.

In FIGS. 1 and 2, the elements which are identical with or correspond to those shown in FIG. 19 are assigned the same reference numerals, and repetition of their detailed explanations is omitted here for brevity.

The ink-jet recording apparatus according to the first embodiment is characterized in that flushing regions 13A and 13B for receiving ink droplets to be ejected when a flushing drive signal is supplied to a recording head 5 are disposed in non-print regions such that the flushing region 13A is provided in the non-print region where capping member 10 for sealing the recording head is disposed and the flushing region 13B is provided in the remaining non-print region which is opposite the capping member 10, with a center print region provided therebetween.

The flushing region 13A provided in the non-print region opposite the capping member 10 is provided in the ink-jet recording apparatus shown in FIG. 19, as well. The flushing region 13A is defined by an aperture 13*a* formed in a paper guide member 8.

An ink-absorbing member 14 which serves as a member not only for absorbing the ink discharged from the capping member 10 by a suction pump 11 but also for retaining the same is disposed below the aperture 13*a* (i.e., at the inner bottom of the ink-jet recording apparatus). The ink-absorbing member 14 is housed in an ink-absorbing member housing case disposed along the paper guide member 8; i.e., a waste-ink tank 15.

The flushing region 13B is newly provided in the non-print region ensured in the vicinity of the capping member 10 for sealing the recording head 5. The flushing region 13B is identical in configuration with the flushing region 13A and is defined by an aperture 13*b* formed in the paper guide member 8.

The ink-absorbing member 14 housed in the waste-ink tank 15 is disposed below the aperture 13*b* (i.e., at the inner bottom of the recording apparatus).

The ink ejected from the recording head 5 for flushing purpose within the flushing region 13A or 13B is absorbed by the ink-absorbing member 14 housed in the waste-ink tank 15.

A control circuit of the recording apparatus having the foregoing configuration will now be described by reference to FIG. 2. In FIG. 2, reference numeral 30 designates a print controller. The print controller 30 produces bit-mapped data on the basis of print data output from a host computer of the recording apparatus. On the basis of the thus-produced bit-mapped data, a head driver 31 generates a drive signal, thus causing the recording head 5 to eject ink.

In addition to producing the drive signal on the basis of print data, the head driver 31 is also configured so as to output a flushing drive signal to the recording head 5 upon receipt of a flushing instruction signal from a flushing controller 32, thus effecting ejecting of ink irrelevant to the printing operation.

Reference numeral 33 designates a cleaning controller. Upon receipt of an instruction signal output from the cleaning controller 33, a pump driver 34 is activated to drive the suction pump 11.

The cleaning controller 33 receives an instruction signal from the print controller 30 and cleaning instruction detector 35.

An instruction switch 36 is connected to the cleaning instruction detector 35. In response to the user depressing the instruction switch 36, the instruction detector 35 is activated, thus enabling manually-instructed cleaning operation.

A carriage position controller 37 is connected to the flushing controller 32. At the time of flushing operation, the flushing controller 32 sends a control signal to the carriage position controller 32, thus activating a carriage motor 38. As a result, the recording head 5 mounted on the carriage 1 is moved to either the flushing region 13A or the flushing region 13B.

At this time, the flushing controller 32 sends a control signal to the carriage position controller 37, thus determining whether the recording head 5 mounted on the carriage 1 is to be moved to the flushing region 13A or to the flushing region 13B, whichever results in a smaller decrease in throughput, in consideration of the direction of printing or the distances between the recording head 5 situated in the print region and the respective flushing regions.

Further, the flushing controller 32 is connected to a fan drive controller 39. At the time of flushing operation, the flushing controller 32 sends a control signal to the fan drive controller 39, to thereby temporarily stop a fan motor 40 which drives a ventilation fan (not shown) for preventing an increase in the internal temperature of the recording apparatus.

As is obvious from the foregoing description, the ink-jet recording apparatus of the first embodiment comprises the flushing regions 13A and 13B for receiving ink droplets to be ejected when a flushing drive signal is supplied to the recording head 5; more specifically, the flushing region 13B is provided in the non-print region where the capping member 10 for sealing the recording head 5 is to be disposed, and the flushing region 13A is provided in the remaining non-print region which is opposite the capping member 10, with the center print region located therebetween. By employment of these flushing regions 13A and 13B, the present invention prevents a problem of much print time being required in association with the flushing operation.

Furthermore, the recording head 5 is to be moved to the flushing region 13A or to the flushing region 13B, whichever results in a smaller decrease in throughput. Thus, the first embodiment can eliminate a problem of considerable print time being required as a result of flushing operation.

An ink-jet recording apparatus according to a second embodiment of the present invention will now be described by reference to FIGS. 3 and 4.

Figure 3:
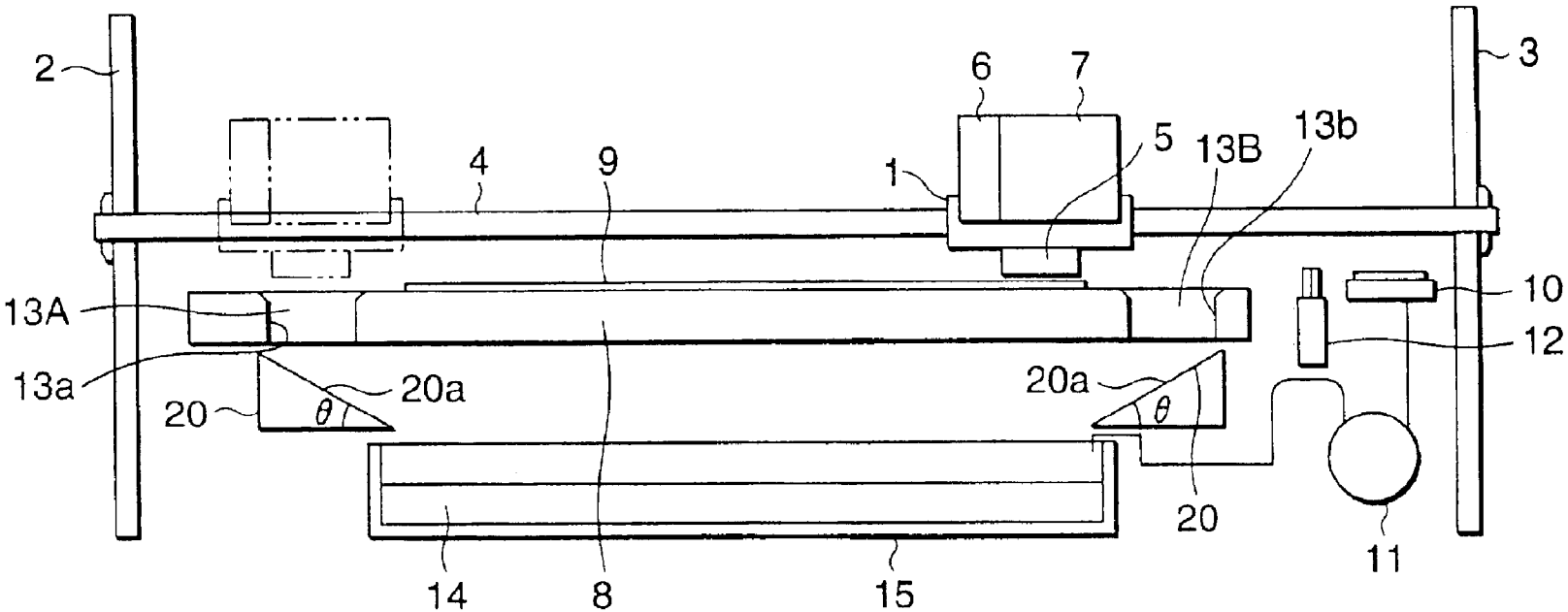
FIG. 3 is a front view showing a main unit of an ink-jet recording apparatus according to a second embodiment of the present invention, with a portion of the main unit being shown in cross section.
Figure 4:
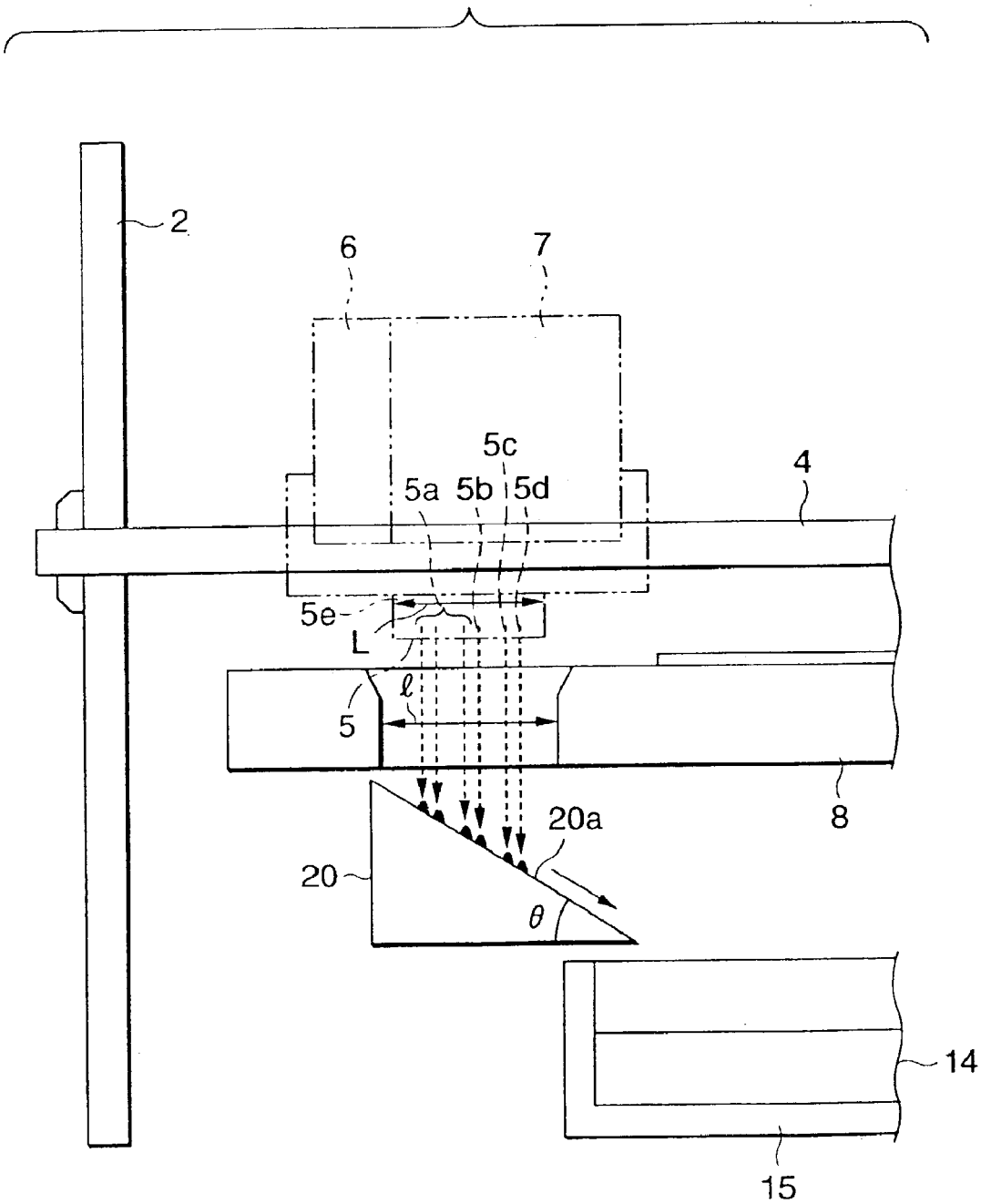
FIG. 4 is an enlarged view of a flushing region shown in FIG. 3.

FIG. 3 shows the configuration of a main unit of the recording apparatus according to the second embodiment, and FIG. 4 is an enlarged view of the flushing region shown in FIG. 3.

In FIGS. 3 and 4, the elements which are identical with or correspond to those shown in FIGS. 1 and 2 are assigned the same reference numerals, and repetition of their detailed explanations is omitted here for brevity.

Since the control circuit of the recording apparatus is identical with that shown in FIG. 2, repetition of its explanation is omitted.

As shown in FIG. 3, the ink-jet recording apparatus of the second embodiment is characterized in that slant members 20, each having a slant surface 20*a* tilted toward the print region, are interposed such the one slant member 20 is interposed between the aperture 13*a* formed in the paper guide member 8 provided in the flushing region 13A and the ink-absorbing member 14 disposed below the aperture 13*a* (i.e., at the inner bottom of the recording apparatus), and the other slant member 20 is interposed between the aperture 13*b* formed in the paper guide member 8 provided in the flushing region 13B and the ink-absorbing member 14 disposed below the aperture 13*b* (i.e., at the inner bottom of the recording apparatus).

As a result of presence of the slant member 20 tilted toward the print region between the aperture 13*a* and the ink-absorbing member 14 disposed below the aperture 13*a*, the ink ejected from the recording head 5 passes through the aperture 13*a* and adheres to the slant surface 20*a* of the slant member 20. Similarly, as a result of presence of the slant member 20 tilted toward the print region between the aperture 13*b* and the ink-absorbing member 14 disposed below the aperture 13*b*, the ink ejected from the recording head 5 passes through the aperture 13*b* and adheres to the slant surface 20*a* of the slant member 20.

When ink adheres to the slant surface 20*a* to a certain extent, ink drops toward the ink-absorbing member 14 in the form of droplets and is absorbed by the ink-absorbing member 14.

As mentioned above, the slant members 20 tapered toward the print region are interposed between the apertures 13*a* and 13*b* and the ink-absorbing member 14 disposed below the apertures 13*a* and 13*b*, to thereby guide to the ink-absorbing member 14 the ink ejected from the recording head 5. Thus, the present invention eliminates a necessity for placing the ink-absorbing member 14 at a position where it faces the flushing regions 13A and 13B.

The recording apparatus is subjected to a less stringent limitation imposed by the layout of other components, thus increasing the degree of freedom in designing a recording apparatus.

Further, the ink-absorbing member 14 can be made compact and placed at the center of the recording apparatus, thus rendering the ink-jet recording apparatus compact.

Although the example shown in FIG. 3 illustrates the slant members 20 disposed in the respective flushing regions 13A and 13B, the slant members 20 are not necessarily required to be placed in both flushing regions 13A and 13B; the slant member 20 may be disposed in either the flushing region 13A or the flushing region 13B.

Further, the slant surfaces 20*a* may be integrally formed with the respective apertures 13*a* and 13*b*.

The slant angle θ of the slant surface 20*a* of the slant member 20 falls within the domain of $0° < \theta < 90°$.

In some cases, as the slant angle θ of the slant surface 20*a* of the slant member 20 approximates 0°, ink adheres to the slant surface 20*a* and fails to drop to the ink-absorbing member 14.

For this reason, the slant angle θ of the slant surface 20*a* is desirably set to an angle of 30° or more.

In contrast, if the slant angle θ of the slant surface 20*a* approximates 90°, the ink-absorbing member 14 cannot be made compact. Therefore, the ink-absorbing member 14 must be disposed at a position where it faces the flushing regions 13A and 13B.

In this case, the slant angle θ of the slant surface 20*a* of the slant member 20 preferably falls within the domain of 30°<θ<60°.

Preferably, the slant surface 20*a* is coated with a water-repellent agent such as silicon, fluorine, TEFLON, or a like chemical.

If the slant surface 20*a* is coated with a water-repellent layer, the ink adhering to the slant surface 20*a* becomes ink droplets and becomes likely to fall to the ink-absorbing member 14, thus preventing solidification of the ink on the slant surface 20*a*.

Even if the slant surface 20*a* has a small slant angle θ, the ink adhering to the slant surface 20*a* becomes ink droplets as a result of the water-repellent layer formed on the slant surface 20*a* and falls to the ink-absorbing member 14. Accordingly, the ink-absorbing member 14 can be made compact.

Figure 5:
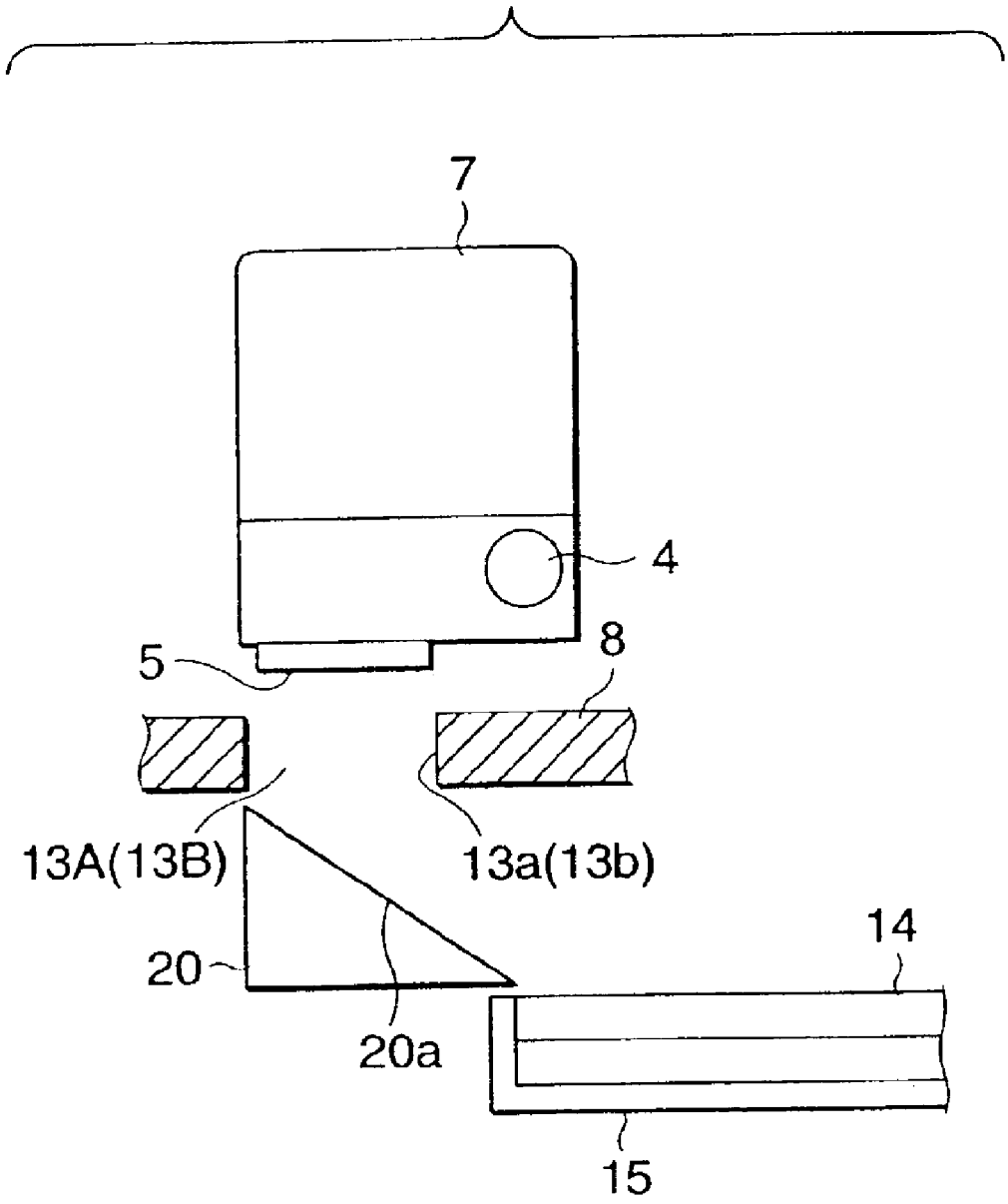
FIG. 5 is a side elevation view of a slant member whose tapered surface is formed in the direction perpendicular to the traveling direction of a carriage, with a portion of the slant surface being shown in cross section.

As shown in FIGS. 3 and 4, the slant surface 20*a* of the slant member 20 is tapered with respect to the traveling direction of the carriage 1. However, as shown in FIG. 5, the slant surface 20*a* may alternatively be tapered with respect to a direction perpendicular to the traveling direction of the carriage 1 (i.e., the direction normal to the drawing sheet of FIG. 5) or at a predetermined angle with respect to the traveling direction of the carriage 1.

As mentioned above, the degree of freedom in laying out the ink-absorbing member 14 can be increased by changing the direction of tapering of the slant surface 20*a*.

Further, as shown in FIG. 4, the size "I" of the apertures 13*a* and 13*b* is preferably made greater than the size "L" of a nozzle plate 5*e* of the recording head 5.

So long as the size "I" of the apertures 13*a* and 13*b* is made greater than the size "L" of the nozzle plate 5*e* of the recording head 5 as mentioned above, the ink ejected from nozzle orifices of the recording head 5 passes through the apertures 13*a* and 13*b* without splashing and is absorbed by the ink-absorbing member 14.

Preferably, nozzle orifices for ejecting ink which are likely to dry and solidify (i.e., ink having high viscosity) are formed in the area of the recording head 5 corresponding to a lower portion of the slant surface 20*a*.

For example, a nozzle orifice 5*d* is desirably used for ejecting black ink.

In other words, at least a nozzle orifice 5*a* is desirably used for ejecting ink of another color, such as yellow, cyan, or magenta.

The illustrated black ink has a higher content of a dye component than do inks of other colors: i.e., yellow, cyan, and magenta. When the solvent contained in the black ink evaporates, the black ink is susceptible to a considerable increase in viscosity and is likely to solidify.

Because of such a property, if black ink adheres to a higher portion of the slant surface 20*a*, the black ink may solidify thereon.

In contrast, if black ink adheres to an intermediate or lower portion of the slant surface 20*a*, the black ink flows down over the slant surface 20*a* without solidification in association with falling of ink adhering to a position higher than the position to which the black ink adheres and is finally absorbed by the ink-absorbing member 14.

The black ink is illustrative, and ink of another color which is likely to dry and solidify (i.e., ink of another color and having high viscosity) may also be employed.

As is mentioned above, the ink-jet recording apparatus of the second embodiment comprises the slant members 20 provided in the respective flushing regions 13A and 13B, and the ink ejected from the recording head 5 is guided to the ink-absorbing member 14 by way of the slant member 20. As a result, the present invention eliminates a necessity for placing the ink-absorbing member 14 at a position where it faces the flushing regions 13A and 13B. The recording apparatus is subjected to a less stringent limitation imposed by the layout of other components, thus increasing the degree of freedom in design of a recording apparatus.

The ink-absorbing member 14 can be made more compact, thus rendering the ink-jet recording apparatus compact.

An ink-jet recording apparatus according to a third embodiment of the present invention will now be described.

Figure 6:
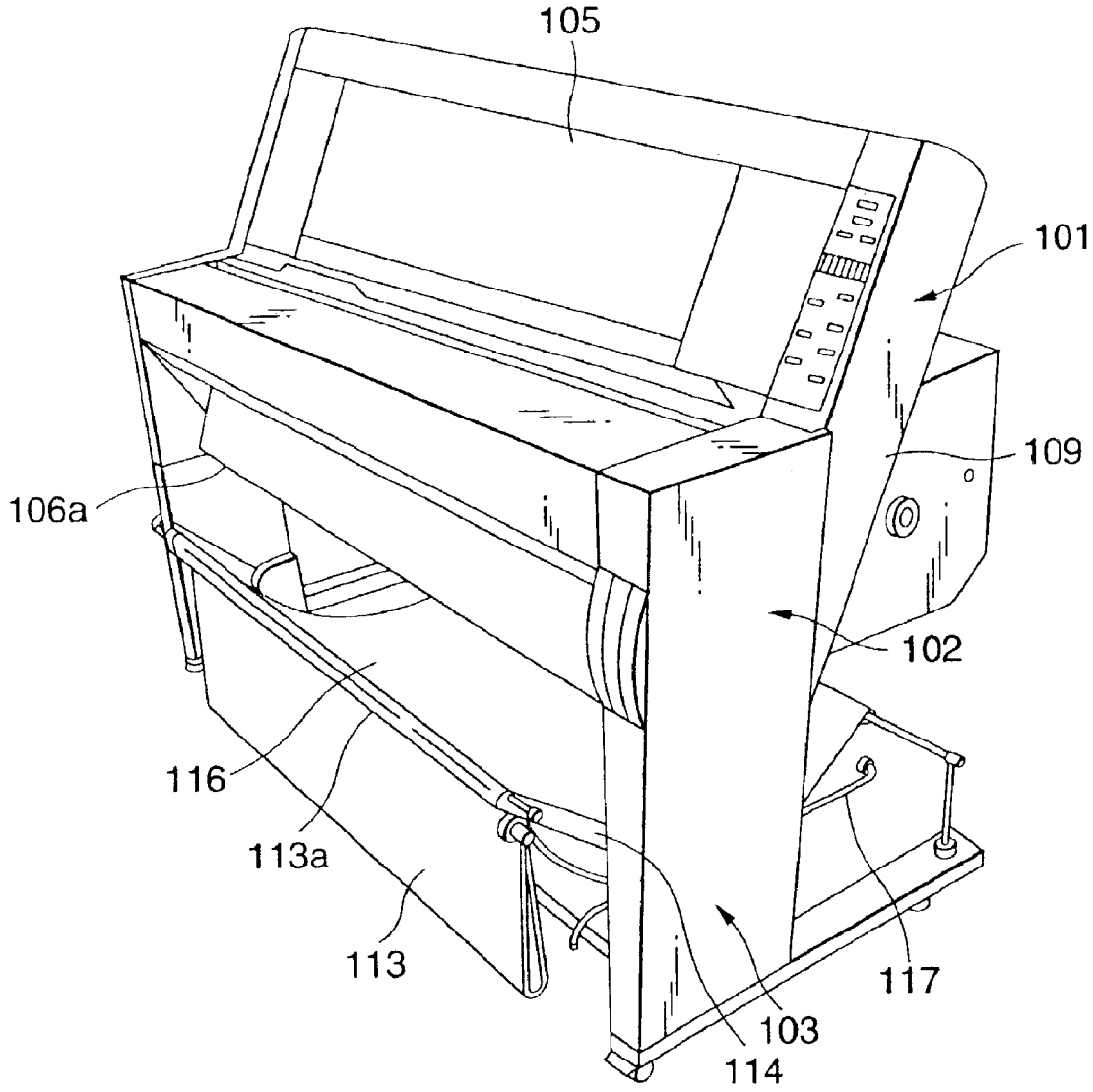
FIG. 6 is a perspective external view showing one example of a large-sized ink-jet recording apparatus to which the present invention is applied.
Figure 7:
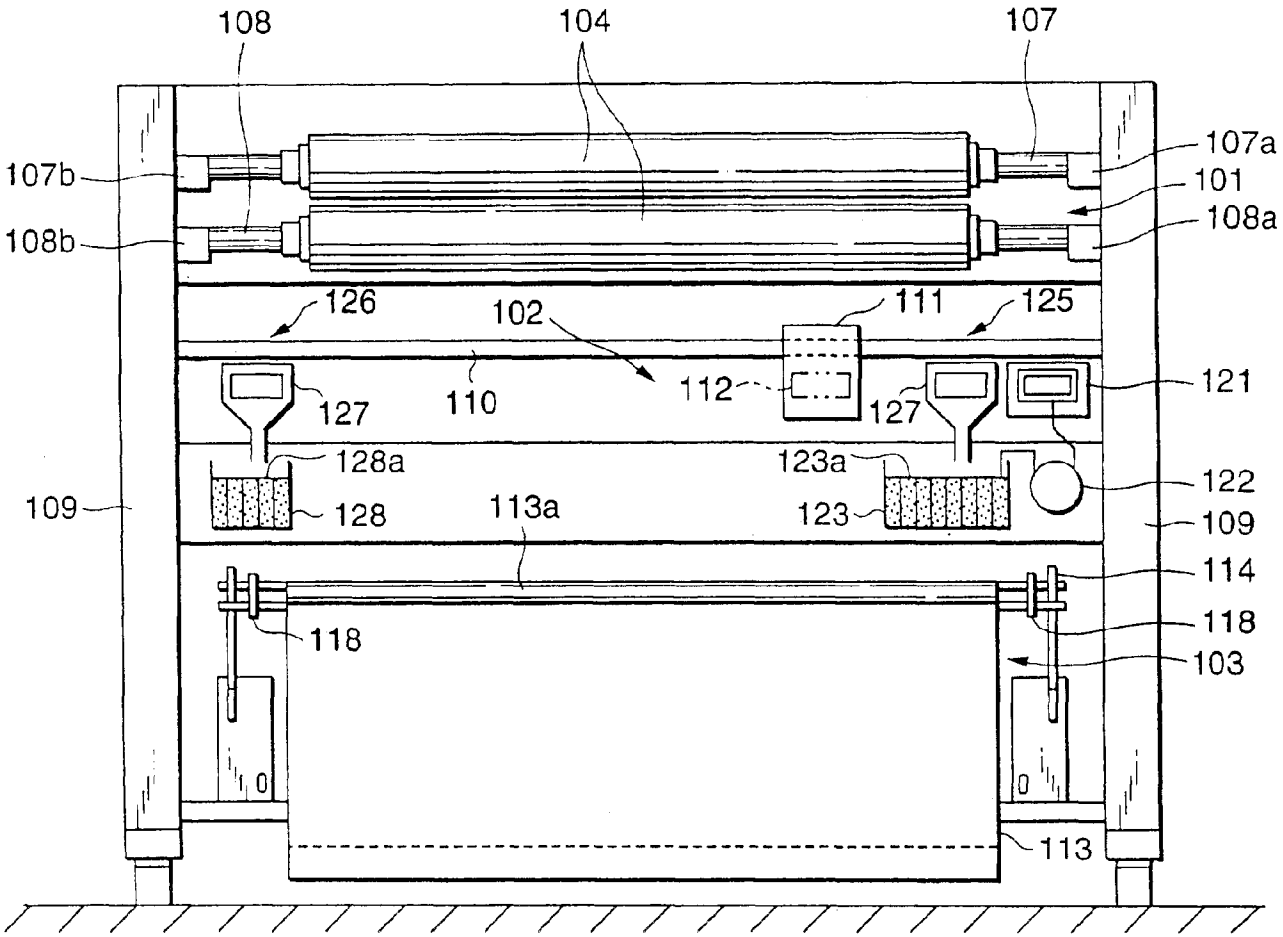
FIG. 7 is a front view showing the outline of the internal configuration of the recording apparatus shown in FIG. 6.

FIGS. 6 and 7 show the configuration of a large-sized ink-jet recording apparatus (hereinafter also called "printer") installed directly on the floor. FIG. 6 is a perspective outline of the printer, and FIG. 7 is a front view showing the internal configuration of the printer.

Figure 8:
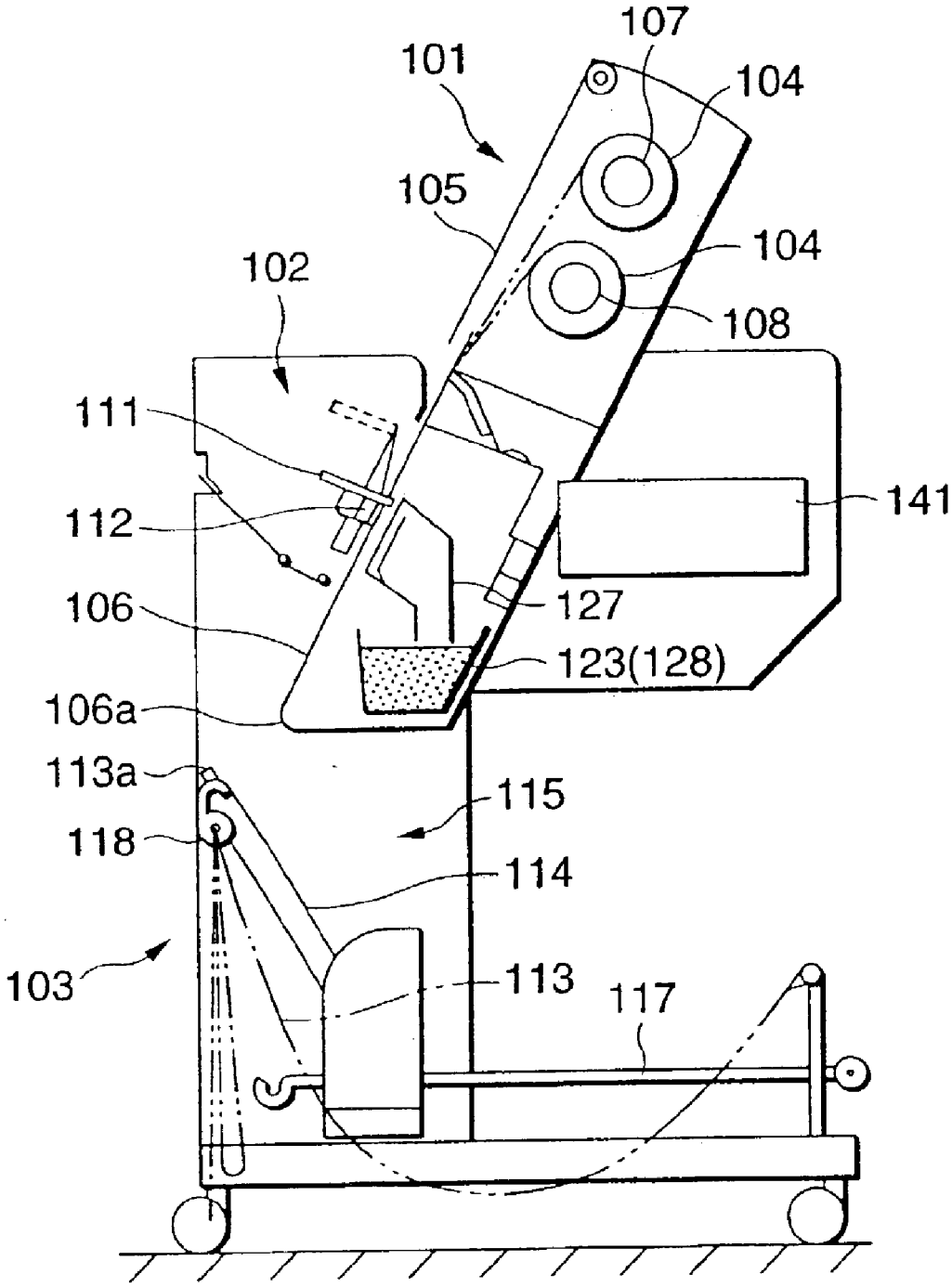
FIG. 8 is a longitudinal cross-sectional view of the recording apparatus shown in FIG. 7 as taken through a flushing region.

FIG. 8 is a longitudinal cross-sectional view of the printer shown in FIG. 7 taken through a flushing region to be described later.

In this printer are arranged a paper feed section 101, a print section 102, and a paper output section 103, in this order from top to bottom.

A paper transport channel is formed into a substantially linear path which is tilted relative to the vertical line and extends from the paper feed section 101 to the paper output section 103 by way of the print section 102.

As shown in FIGS. 7 and 8, long roll paper 104 having a width of, for example, up to 40 inches can be loaded on the paper feed section 101 as a recording medium. At the time of replacement, the roll paper 104 can be removed. The position where the paper supply section 101 is set is optimal for the operator replacing the roll paper 104 with new roll paper while remaining in a standing position.

As shown in FIG. 6, the front surface of the roll paper 104 loaded on the paper feed section 101 can be covered with a reclosable roll paper cover 105. When the roll paper cover 105 is in a closed position, the upper surface of the roll paper cover 105, the print section 102, and a paper delivery guide 106 to be described later are substantially brought into alignment, thus enabling supply or discharge of paper, such as a rigid cardboard, of a type other than the roll paper 104.

As shown in FIG. 7, in the paper feed section 101 a pair of spindle receivers 108*a*, 108*b* are disposed below another pair of spindle receivers 107*a*, 107*b*.

The spindle receiver pairs 107 and 108 are mounted on a pair of frames 109, 109 of the printer main unit.

A spindle 107 having the long roll paper 104 fitted thereon is supported by the spindle receivers 107*a* and 107*b*, and another spindle 108 having the long roll paper 104 fitted thereon is supported by the spindle receivers 108*a* and 108*b*.

As can be seen from FIGS. 6 and 7, the upper spindle 107 and the lower spindle 108 are aligned so as to be parallel and to assume a diagonal relationship; specifically, the lower spindle 108 is located closer to the operator than the upper spindle 107.

The respective sheets of roll paper 104 are transported along the paper transport path, which is formed substantially linearly and inclined toward the entrance of the paper output section 103 by way of the print section 102.

As shown in FIG. 7, a guide rod 110 is provided in the print section 102 and is horizontally attached to the frames 109, 109. A carriage 111 is provided on the guide rod 110 so as to travel back and forth along the same, and a recording head 112 is mounted on the carriage 111.

The paper delivery guide 106 is formed below the area scanned by the recording head 112, so as to constitute a portion of the paper transport path.

The paper output section 103 receives printed paper and comprises a catch cloth 113 whose paper-receiving surface is formed from a collapsible canvas sheet.

As shown in FIG. 8, the paper output section 103 is switched by a paper delivery changeover lever 114 so as to guide printed paper to a first receiving section 115 located substantially immediately below the print section 102 or so as to guide printed paper to an unillustrated second receiving section which is temporarily formed in the vicinity of the front side of the printer by expansion of the catch cloth 113 over the floor in front of the printer main unit.

In a case where printed paper is guided to the first receiving section 115, an opening 116 is formed between a rear edge 106*a* of the paper delivery guide 106 situated at a position lower than the print section 102 and an upper edge 113*a* of the catch cloth 113 protruding into the paper transport path, by means of the paper delivery changeover lever 114.

In a case where printed paper is guided to the second receiving section, the upper edge 113*a* of the catch cloth 113 is retracted backward relative to the paper transport path, by means of the paper delivery changeover lever 114. A catch cloth fixing lever 117 is withdrawn from the front side of the printer, and a hook 118 on which the front end of the catch cloth 113 is fixed is engaged with the front end of the fixing lever 117, whereby the catch cloth 113 can be spread to extend forward of the front side of the printer main unit.

As shown in FIG. 7, one end of the area over which the recording head 112 mounted on the carriage 111 travels corresponds to a non-print region (the home position), where a capping member 121 is disposed.

The recording head 112 is mounted on the carriage 111 such that a nozzle forming surface of the recording head 112 is slightly tilted relative to the perpendicular, as will be described later. The capping member 121 is arranged so as to seal the nozzle forming surface of the recording head 112 when the recording head 112 moves to the non-print region.

A suction pump 122 for imparting negative pressure to the interior space of the capping member 121 is provided below the capping member 121.

The capping member 121 acts as a cap member for preventing drying of the nozzle orifices of the recording head 112 while the printer is in an idle mode. Further, the capping member 121 acts as head cleaning means for sucking ink by imparting negative pressure generated by the suction pump 122 to the recording head 112.

The waste ink discharged by the suction pump 122 is delivered to a first waste ink tank 123 and is absorbed by a waste-fluid absorbing material 123*a* housed in the tank 123.

A first flushing region 125 is formed on the path over which the recording head 112 travels, so as to become adjacent to the capping member 121. An ink receiver unit 127, which will be described in detail by reference to FIG. 9, is disposed in the first flushing region 125. The waste ink collected by the ink receiver unit 127 is delivered to the first waste ink tank 123 and is absorbed by the waste-fluid absorbing material 123*a* housed in the tank 123.

A second flushing region 126 is formed in the remaining end opposite the capping member 121, with the center print area placed therebetween.

The ink receiver unit 127 is provided even in this second flushing region 126, and the waste ink collected by the ink receiver unit 127 is delivered to a second waste-fluid tank 128, where the waste ink is absorbed by a waste-fluid absorbing material 128*a* housed in the tank 128.

The ink-jet recording apparatus is pre-installed with a flushing sequence for selectively using either the first or second flushing region, according to the width of paper to be subjected to printing, as required. As a result, the reliability of printing can be ensured by flushing without involvement of a decrease in throughput.

As shown in FIG. 8, cartridge holders 141 for retaining ink cartridges are provided at opposite ends of and behind the print section 102 of the recording apparatus.

Each cartridge holder 141 is configured so as to be pivotable through about 45 degrees between a cartridge exchange mode and an ink supply mode. In the cartridge exchange mode, the cartridge holder 141 is tilted from its longitudinal direction at an angle of 45 degrees, to thereby enable the operator to exchange ink cartridges. In the ink supply mode, the cartridge holder 141 is in a horizontal position, and ink is supplied to the recording heads.

Figure 9B:
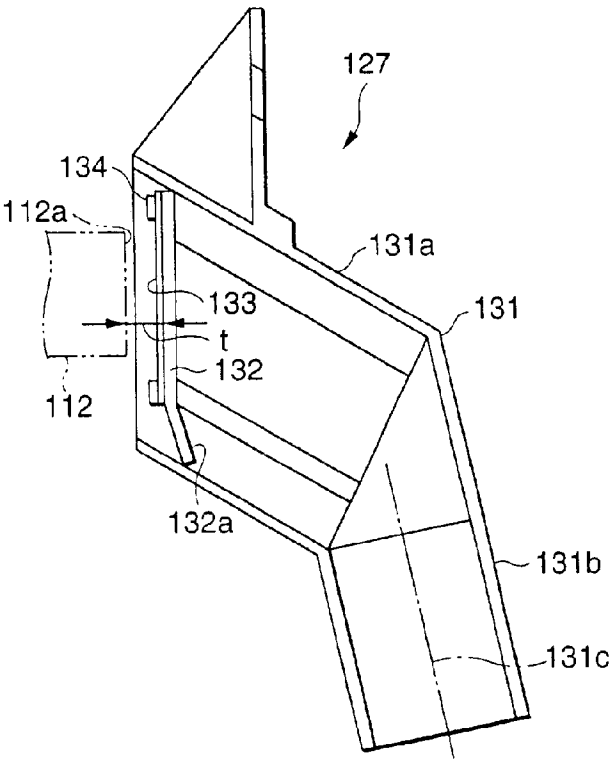
Figure 9A:
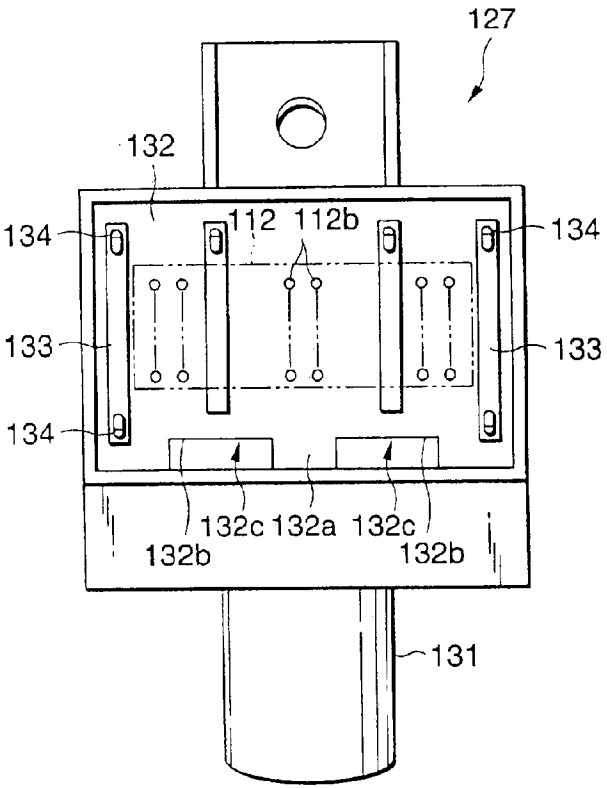

FIG. 9 shows the configuration of the ink receiver units 127 disposed in the respective first and second flushing regions. FIG. 9A is a front view of the ink-receiver unit, and FIG. 9B is a longitudinal cross-sectional view of the ink-receiver unit taken along substantially the center thereof.

The ink receiver unit 127 comprises a case member 131 and a porous sheet 132. The case member 131 is divided, along its center, into a first cylindrical body 131*a* and a second cylindrical body 131*b*. The first cylindrical body 131*a* forms an angle of about 130° with the second cylindrical body 131*b*. An opening is formed in the first cylindrical body 131*a* of the case member 131, and the substantially-square porous sheet 132 is attached to the opening.

The ink receiver unit 127 is attached to the recording apparatus such that an axial line 131*c* of the second cylindrical body 131*b* is aligned substantially normal to the recording apparatus.

The porous sheet 132 is attached to the square opening formed in the first cylindrical body 131*a*, by means of four strip-shaped attachment members 133. The four strip-shaped attachment members 133 are secured on a rib formed within the first cylindrical body 131*a*, by means of screws 134. As shown in FIG. 9B, the periphery of the porous sheet 132 is surrounded by the opening of the case member 131. The ink ejected for flushing purpose flows over the interior of the case member 131 via the porous sheet 132 and is absorbed by the waste-fluid absorbing material 123*a* (128*a*).

As indicated by a phantom line (two-dot chain line) shown in FIG. 9B, the porous sheet 132 is arranged such that the distance "t" between the nozzle forming surface 112*a* of the recording head 112 and the porous sheet 132 preferably assumes a value of about 1 to 5 mm when the recording head 112 is situated in the flushing region.

The smaller the distance "t," the smaller the chance of a mist being caused by flushing. However, if the distance "t" is set to a value of less than 1 mm, the nozzle forming surface 112*a* of the recording head 112 is prone to being damaged by movement of the recording head 112 for reasons of an error in the attachment of a drive mechanism or unit, thus deteriorating the reliability of operation.

If the distance "t" exceeds a value of 5 mm, the ink droplets ejected from the nozzle orifices during flushing are suspended in the air to an unacceptably great extent.

Preferably, the mean pore size of the porous sheet 132 falls within the domain of about 100 to 500 μm.

A comparatively large mean pore size is desirable. If the mean pore size exceeds 500 μm, the ink-retention capability of the porous sheet 132 is deteriorated.

If the mean pore size assumes a value of less than 100 μm, the ink-retention capability of the porous sheet 132 is increased. For instance, in a case where the recording apparatus remains in a non-print mode over a comparatively long period of time and the porous sheet becomes dried, the porous sheet is susceptible to clogging, thus deteriorating the function of the recording apparatus.

Preferably, material subjected to hydrophilic processing is used as the porous sheet. As a result, ink encounters difficulty in remaining on the surface of the porous sheet, thus preventing splashing of ink during flushing.

As shown in FIG. 9B, a lower edge 132*a* of the porous sheet 132 is slightly bent toward the inside of the first cylindrical body 131*a* and is brought into contact with the interior wall of the first cylindrical body 131*a*.

By means of such a configuration, the amount of ink exceeding the ink-retention capability of the porous sheet 132 can efficiently travel to the interior wall surface of the cylindrical body 131*a*. The superfluous ink can flow to the waste-fluid absorbing material 123*a* by way of the second cylindrical body 131*b* whose axial core is aligned substantially to the recording apparatus.

As shown in FIG. 9A, two rectangular notches 132*b* are formed in the lower edge 132*a* of the porous sheet 132 which remains in contact with the interior wall surface of the cylindrical body 131*a*. The notches 132*b* constitute openings 132*c* communicating with the interior wall surface of the first cylindrical body 131*a*.

In the event that the porous sheet 132 becomes clogged and the ink-retention capability of the porous sheet 132 becomes deteriorated, the ink ejected for flushing is temporarily received by the porous sheet 132 and is guided to the inside of the first cylindrical body 131*a* by way of the openings 132*c*.

The operational reliability of the ink receiver unit 127 can be ensured over a long period of time.

As shown in FIG. 9A, the openings 132*c* are desirably formed so as not to extend to a position where they face the row of nozzle orifices 112*b* of the recording head 112.

By means of such a configuration, the ink ejected from the nozzle orifices 112*b* flies directly to the surface of the porous sheet 132 without fail, thus preventing occurrence of a mist, which would otherwise be caused when the ink flies to the openings 132*c*.

If the attachment members 133 are provided at positions where they face the row of nozzle orifices 112*b*, ink droplets remain on the surface of the attachment members 133 and are splashed, thus staining the nozzle forming surface 112*a* and the surroundings thereof.

Staining of the nozzle forming surface 112*a* and the surroundings thereof can be prevented, by selection of positions where the attachment members 133 are to be mounted, in the manner as mentioned previously.

Although the foregoing description is based on the case where the ink-jet recording apparatus of the third embodiment corresponds to a particularly large-sized recording apparatus shown in FIGS. 6 through 8, the present invention is not limited to such a specific type of recording apparatus. Needless to say, the same working-effect can be yielded even when the present invention is applied to another type of ink-jet recording apparatus.

As is evident from the foregoing description, in the ink-jet recording apparatus of the third embodiment, the porous sheet 132 is provided so as to become close to and face the recording head 112 when the recording head 112 is situated in the flushing region 125 or 126. The majority of ink droplets ejected from the recording head for flushing can be captured and absorbed by the porous sheet 132.

The ink droplets received by the porous sheet 132 are transferred to and absorbed by the waste-fluid absorbing material 123*a* by way of the case member 131 retaining the porous sheet 132.

Consequently, the chance of a portion of the ink droplets being suspended in the air in the form of a mist can be minimized.

Thus, the third embodiment can provide an ink-jet recording apparatus whose commercial value is improved to a great extent and which solves the problem of occurrence of a mist, which would otherwise stain the inside and outside of the recording apparatus.

An ink-jet recording apparatus according to a fourth embodiment of the present invention will now be described.

FIGS. 6 through 8 used in connection with the description of the ink-jet recording apparatus of the third embodiment are referred to, exactly as they are, for describing the ink-jet recording apparatus according to the fourth embodiment.

Other than FIG. 10, which shows the configuration of an ink receiver unit characterizing the fourth embodiment, explanations of the configuration, elements, and reference numerals provided in FIGS. 6 through 8 are omitted here for brevity.

Figure 10B:
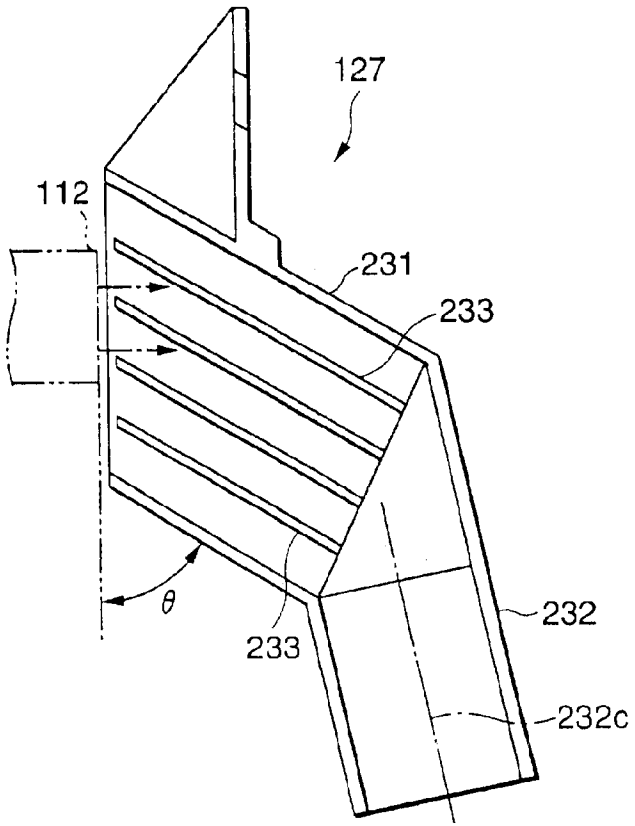
Figure 10A:
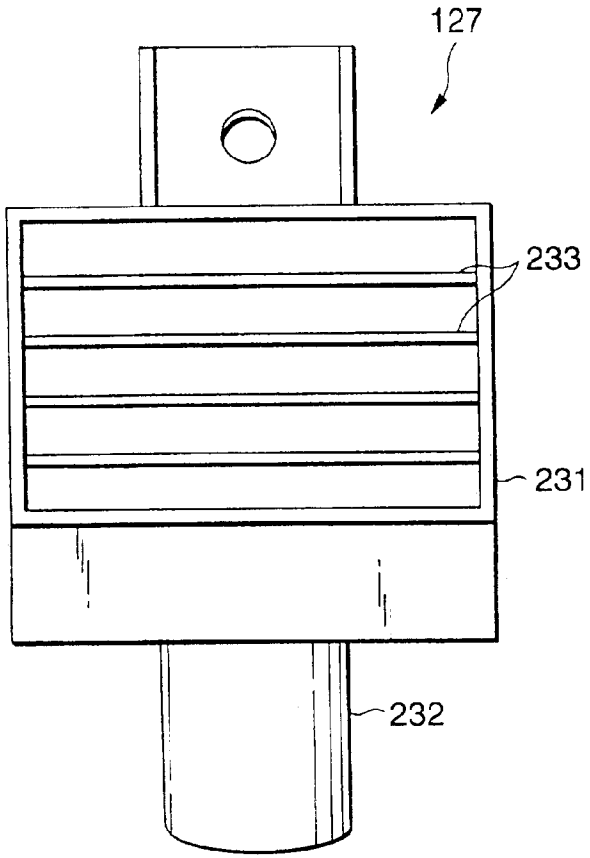

FIG. 10 shows configuration of an ink receiver units 127 to be disposed in the respective first and second flushing regions 125 and 126 in the ink-jet recording apparatus shown in FIGS. 6 through 8. FIG. 10A is a front view of the ink receiver unit, and FIG. 10B is a longitudinal cross-sectional view of the ink receiver unit taken substantially along its center.

The ink receiver unit 127 comprises a cylindrical section 231 whose opening is directed toward the direction of flight of the ink droplets ejected from the recording head 112, and a cylindrical guide section 232 for guiding ink toward the waste-fluid tank 123 or 128. The cylindrical section 231 and the cylindrical guide section 232 are integrally formed from synthetic resin. The ink receiver unit 127 is attached to the recording apparatus such that an axial line 232*c* of the guide section 232 is aligned substantially normal to the recording apparatus.

A plurality of plate members 233 for receiving ink droplets are provided within the cylindrical section 231 at a predetermined angle with respect to the direction of flight of the ink droplets ejected from the recording head 112.

In the fourth embodiment, four plate members 233 are provided in the cylindrical section 231. The plate members 233 are arranged at substantially a uniform interval within the cylindrical section 231 and in parallel with the axis of the cylindrical section 231, because of a limitation imposed by rapping operation.

In the present embodiment, the plate members 233 are set such that the direction of the plate forms an angle of about 60° with the direction of flight of the ink droplets ejected from the recording head 122. As shown in FIG. 10B, the angle θ which is formed by an extension of the nozzle forming surface 112*a* of the recording head 112 and the axial core of the cylindrical section 231 is 60°.

As indicated by the dashed-arrows shown in FIG. 10B, the ink droplets ejected from the recording head impinge on and are captured by the surface of each of the plate members 233 at an angle of about 30°. The waste ink captured by the respective plate members 233 is guided to the waste-fluid tank 123 or 128 located below the plate members 233, or in the direction in which gravity acts, by way of the interior of the guide section 232.

As mentioned above, in the present embodiment the angle formed by the direction of flight of the ink droplets ejected from the recording head 112 and the orientation of the plate members is 60°. Preferably, the angle is set so as to fall within the domain of 40° to 80°.

If the angle is less than 40°, the distance over which ink droplets are to fly can be reduced. However, the angle at which the ink droplets impinge on the surface of the plate members 233 becomes too close to the perpendicular, and the ink droplets are splashed by the surface of the plate members 233, resulting in generation of a mist.

In contrast, if the angle is in excess of 80°, the average distance over which ink droplets are to fly becomes greater, thus resulting in an increase in the degree of formation of a mist.

Particularly, in a case where ink droplets ejected from the recording head 112 pass by the plate members 233 close to the orifices and are received by other plate members 233 distant from the orifices, as indicated by the chained arrows shown in FIG. 10B, the distance over which the ink droplets are to fly becomes extremely long, thus resulting in an increase in the degree of formation of a mist.

Further, as shown in the present embodiment, in a case where the recording head 112 is attached to the carriage 111 such that ink droplets are ejected in substantially a horizontal direction, if the angle formed between the direction of flight of ink droplets and the orientation of the plate members 233 exceeds 80°, the axis of the cylindrical section 231 becomes close to the horizontal direction, thus deteriorating flow of waste ink within the cylindrical section 231.

Even when the angle assumes a larger value, the distance over which ink droplets are to fly can be reduced by means of increasing the number of the plate members 233. However, an increase in the number of the plate members 233 results in a decrease in the interval between the plate members 233, thus deteriorating outflow of ink and operability for maintenance.

For the foregoing reasons, the angle is desirably set so as to fall within the domain of 40° to 80°.

Although four plate members 233 are provided in the fourth embodiment, the number of plate members 233 can be changed to an appropriate value according to the size of the cylindrical section 231 constituting the plate members 233, as required.

Although the foregoing description is based on the case where the ink-jet recording apparatus corresponds to a particularly large-sized recording apparatus shown in FIGS. 6 through 8, the present invention is not limited to such a specific type of recording apparatus. Needless to say, the same working-effect can be yielded even when the present invention is applied to another type of ink-jet recording apparatus.

As is evident from the foregoing description, the ink-jet recording apparatus of the fourth embodiment is equipped with the ink receiver units 127 for receiving ink droplets ejected from the recording head 112 which are located within the respective flushing regions 125 and 126. The plurality of plate members 233 are disposed within each of the ink receiver units 127 such that the angle formed by the direction of flight of ink droplets ejected from the recording head 112 and the orientation of the plate members 233 is set to about 60°. Ink droplets ejected for flushing are captured by any one of the plate members 233 within a comparatively short distance over which the ink droplets fly.

By means of such a configuration, the chance of a portion of ink droplets being suspended in the air in the form of a mist can be diminished, thus solving a problem of generation of a mist, which would otherwise stain the inside and outside of the recording apparatus.

An ink-jet recording apparatus according to a fifth embodiment of the present invention will now be described with reference to FIGS. 2 through 4 and 11 through 14.

FIGS. 2 through 4 used in connection with the description of the ink-jet recording apparatus of the second embodiment are referred to, exactly as they are, for describing the ink-jet recording apparatus according to the fourth embodiment.

Figure 11:
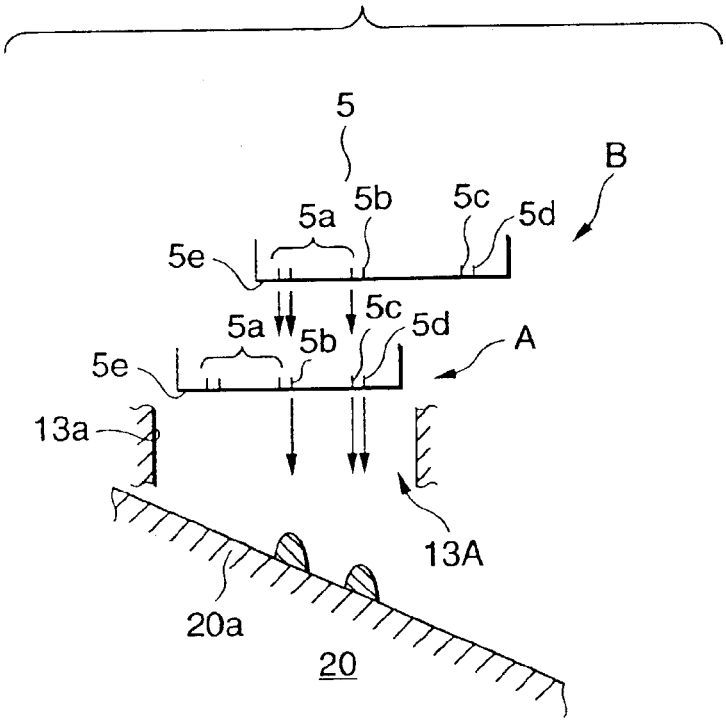
FIGS. 11 and 12 are conceptual renderings for describing flushing operation to be performed according to a fifth embodiment of the present invention.
Figure 12:
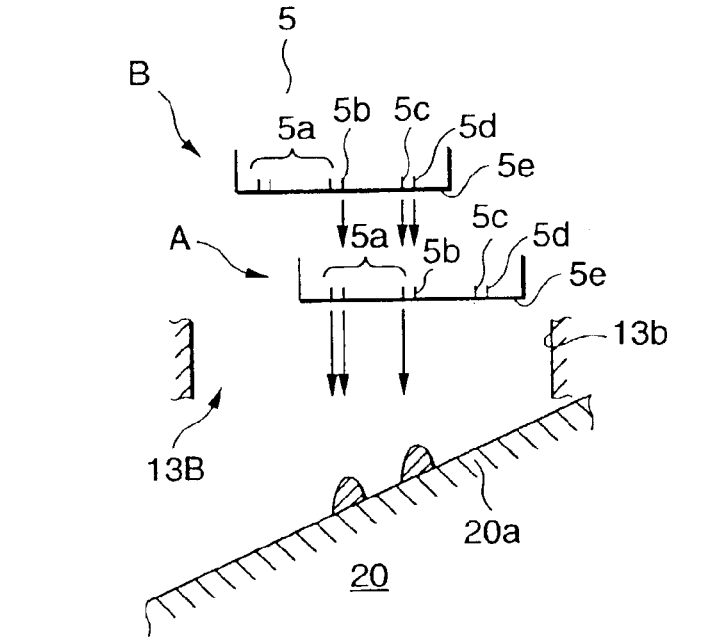

FIGS. 11 and 12 are schematic representations for describing the flushing operation to be performed in this embodiment.

Figure 13A:
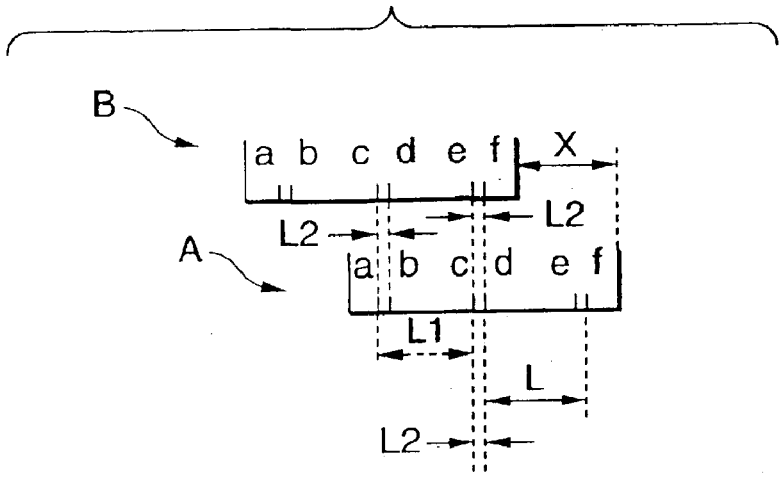
FIGS. 13A and 13B are conceptual renderings for describing the position of a recording head while the recording head is flushed.
Figure 13B:
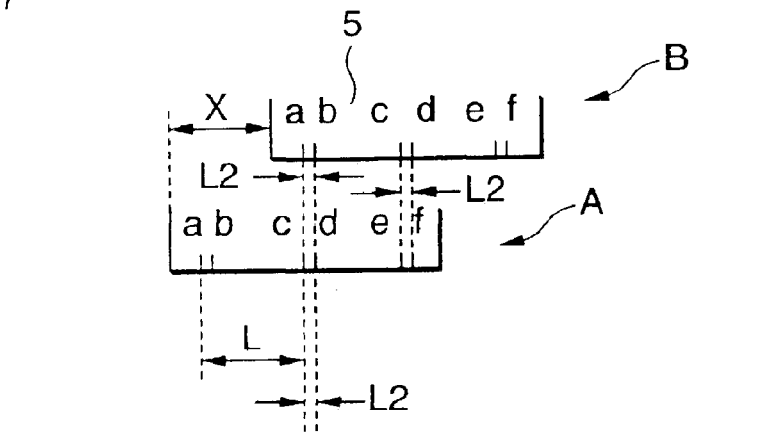

FIGS. 13A and 13B are schematic representations for describing the position of the recording head where the recording head is to be flushed. FIG. 13A shows the position of the recording head within the flushing region 13B, and FIG. 13B shows the position of the recording head within the flushing region 13A.

Figure 14:
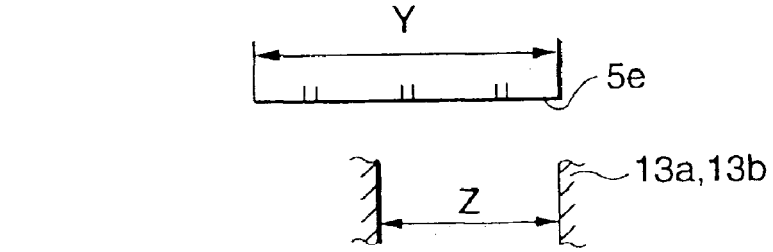
FIG. 14 is a conceptual rendering for describing the size of a nozzle plate and the size of an aperture according to a sixth embodiment of the present invention.

FIG. 14 is a conceptual rendering for describing the sizes of the nozzle plate and the aperture.

Since the configuration, elements, and reference numerals shown in FIGS. 2 through 4 have already been described, repetition of their explanations is omitted here for brevity.

As shown in FIGS. 11 and 12, the recording head 5 comprises three sets of nozzle orifices, each set including two rows of nozzle orifices. As shown in FIG. 11, three rows of nozzle orifices arranged at the left side (i.e., the leftmost set of nozzle orifices and a single row of nozzle orifices of the middle set) 5*a* eject black ink. The remaining row of nozzle orifices of the middle set 5*b* adjacent to the nozzle orifices 5*a* eject yellow ink. A row of nozzle orifices 5*c* of the right-side set adjacent to the row of nozzle orifices 5*b* eject cyan ink, and the remaining, rightmost row of nozzle orifices 5*d* of the right-side set adjacent to the row of nozzle orifices 5*c* eject magenta ink.

Flushing operation will now be described.

Flushing operations performed within the respective flushing regions 13A and 13B are based on the same principle. First, the flushing operation performed within the flushing region 13B will be described.

Upon receipt of a control signal from the flushing controller 32 shown in FIG. 2, the carriage position controller 37 sends a control signal, thus activating a pulse motor for moving the carriage 1 and moving the recording head 5 of the carriage 1 to position A (called a first position) within the flushing region 13B, where the carriage 1 is stopped.

When the recording head 5 of the carriage 1 arrives at position A shown in FIG. 12 (i.e., the first position), the carriage position controller 37 sends a control signal to the flushing controller 32, whereupon black ink is ejected from the nozzle orifices 5*a* assigned to black ink.

At this time, other colors of ink are not ejected from the nozzle orifices 5*b*, 5*c*, and 5*d* assigned to yellow ink, cyan ink, and magenta ink, respectively.

Consequently, only the black ink ejected from the nozzle orifices 5*a* adheres to the slant surface 20*a*.

The black ink adhering to the slant surface 20*a* flows downward over the slant surface 20*a* and is absorbed by the ink-absorbing member 14.

Since black ink has a higher solid concentration than do yellow ink, cyan ink, and magenta ink, the black ink is susceptible to an increase in viscosity and is likely to solidify when solvent contained in the black ink evaporates.

After ejecting of black ink is completed, the flushing controller 32 sends a control signal to the carriage position controller 37, which in turn sends a control signal, thus activating the pulse motor for moving the carriage 1. As a result, the carriage 1 is moved to position B shown in FIG. 12 (called a second position), where the carriage 1 is stopped.

Position A (i.e., the first position) is set on the rightmost end of a range over which the carriage 1 can travel, and position B (i.e., the second position) is set on a position closer to the center print region relative to the first position.

As shown in FIG. 12, a positional relationship between position A (the first position) and position B (the second position) is determined such that an overlap exists between the nozzle orifices for ejecting black ink when the recording head 5 is located at position A and the nozzle orifices for ejecting yellow ink, cyan ink, and magenta ink when the recording head 5 is located at position B.

When the carriage 1 arrives at position B (the second position), the carriage position controller 37 sends a control signal to the flushing controller 32, whereupon the nozzle orifices 5*b*, 5*c*, and 5*d*, which are assigned to yellow ink, cyan ink, and magenta ink, respectively, eject these colors of ink.

At this time, black ink is not ejected from the nozzle orifices 5*a* assigned to black ink.

Consequently, only the yellow ink, cyan ink, and magenta ink ejected from the corresponding nozzle orifices 5*b*, 5*c*, and 5*d* adhere to the slant surface 20*a*.

The yellow ink, cyan ink, and magenta ink adhering to the slant surface 20*a* flows downward over the slant surface 20*a* and are absorbed by the ink-absorbing member 14.

At this time, even if the black ink ejected at position A (the first position) does not flow downward over and instead adheres to the slant surface 20*a*, the yellow ink, cyan ink, and magenta ink ejected at position B (the second position) will be mixed with the black ink adhering to the slant surface 20*a*, thus preventing solidification of the black ink. Accordingly, the black ink flows downward over the slant surface 20 and is absorbed by the ink-absorbing member 14.

As mentioned above, since a specific positional relationship exists between position A (the first position) and position B (the second position), other colors of ink can adhere to the position where black ink is to adhere, thus preventing solidification of black ink.

In the present embodiment, an overlap exists between the nozzle orifices for ejecting black ink when the recording head is located at position A (the first position) and the nozzle orifices for ejecting yellow ink, cyan ink, and magenta ink when the recording head is located at position B (the second position). However, the present invention is not limited to such a configuration.

As shown in FIG. 13A, the recording head comprises three sets of nozzle orifices, each set including two rows of nozzle orifices. Given that respective rows of nozzle orifices are assigned reference symbols "a" to "f," that L1 represents the distance between the row of nozzle orifices "a" and the row of nozzle orifices "c" and the distance between the row of nozzle orifices "b" and the row of nozzle orifices "e," and that L2 represents the distance between the row of nozzle orifices "a" and the row of nozzle orifices "b," the distance between the row of nozzle orifices "c" and the row of nozzle orifices "d," and the distance between the row of nozzle orifices "e" and the row of nozzle orifices "f," distance "X" between position A (the first position) and position B (the second position) is defined as $$L1-L2 \leqq X \leqq L1+L2.$$

If the distance X falls within the domain of $2(L1-L2) \leqq X \leqq 2(L1+L2)$, the yellow ink, cyan ink, and magenta ink ejected at position B (the second position) are sufficiently mixed with the black ink adhering to the slant surface 20*a*, thus preventing solidification of the black ink.

For this reason, essential requirement is that the distance X between position A (the first position) and position B (the second position) falls within the domain of $L1-L2 \leqq X \leqq L1+L2$ or $2(L1-L2) \leqq X \leqq 2(L1+L2)$.

In the previous embodiments, after the carriage has stopped at either position A (the first position) or position B (the second position), predetermined ink is to be ejected.

However, the present invention is not limited to such a configuration. The yellow ink, cyan ink, and magenta ink, which are ejected at position B (the second position), may be ejected while the carriage is in motion.

Specifically, when the carriage arrives at position B (the second position), yellow ink, cyan ink, and magenta ink may be ejected without stoppage of the carriage; namely, while the carriage is in motion.

By means of such a configuration, even if the black ink ejected at position A (the first position) splashes to a wide extent over the slant surface 20*a*, the thus-splashed black ink can be prevented from becoming solidified, flows downward over the slant surface 20*a*, and is absorbed by the ink-absorbing member 14.

Even under this flushing method, black ink is ejected at position A (the first position) while the carriage is stopped, in order to prevent splashing of black ink over a wide range.

In the previous embodiments, position A (the first position) and position B (the second position) are set in pre-determined locations. However, the present invention is not limited to such embodiments. Position B (the second position) may be set to a fixed position, and position A (the first position) may be changed whenever necessary, such that the distance X between position A (the first position) and position B (the second position) is limited within the domain of $L1-L2 \leqq X \leqq L1+L2$ or $2(L1-L2) \leqq X \leqq 2(L1+L2)$.

Conversely, position B (the second position) may be changed, whenever necessary.

Particularly, in a case where position A (the first position) can be changed whenever necessary, position A (the first position) is desirably prevented from being set in the same location, by changing the location every time ink is ejected at position A (the first position). In this case, even if black ink to be ejected at position A (the first position) becomes solidified, the black ink is prevented from being deposited on a single location on the slant surface 20*a* as a result of shifting of position A (the first position).

In the previous embodiments, the first ink is to be ejected when the carriage is stopped at the first position of the recording head. However, the first ink may be ejected at the instant at which the carriage begins to accelerate.

Alternatively, black ink may be ejected when the carriage has arrived at position A (the first position), without the carriage being stopped. Further, the first ink may be ejected at the instant the carriage begins to accelerate, and other colors of ink; i.e., yellow ink, cyan ink, and magenta ink, may be ejected when the carriage has arrived and is stopped at position B (the second position).

Since black ink is ejected while the carriage is in motion, black ink is prevented from being deposited on a single location on the slant surface 20.

The flushing operation to be performed in the flushing region 13A will now be described.

Upon receipt of a control signal from the flushing controller 32, the carriage position controller 37 sends a control signal, thus activating a pulse motor for moving the carriage 1 and moving the recording head 5 of the carriage 1 to position A (called a first position) shown in FIG. 11, where the carriage 1 is stopped.

When the recording head 5 of the carriage 1 arrives at position A (i.e., the first position), the carriage position controller 37 sends a control signal to the flushing controller 32, whereupon yellow ink, cyan ink, and magenta ink are ejected from the nozzle orifices 5*b*, 5*c*, and 5*d* assigned to yellow, cyan, and magenta.

At this time, black ink is not ejected from the nozzle orifices 5*a* assigned to black ink.

Consequently, only the yellow ink, cyan ink, and magenta ink ejected from the nozzle orifices 5*b*, 5*c*, and 5*d* adhere to the slant surface 20*a*.

These colors of ink adhering to the slant surface 20*a* flow downward over the slant surface 20*a* and are absorbed by the ink-absorbing member 14.

After ejecting of yellow ink, cyan ink, and magenta ink is completed, the flushing controller 32 sends a control signal to the carriage position controller 37, which in turn sends a control signal, thus activating the pulse motor for moving the carriage 1. As a result, the carriage 1 is moved to position B shown in FIG. 11 (called a second position), where the carriage 1 is stopped.

Position A (i.e., the first position) is set on the leftmost end of a range over which the carriage 1 can travel, and position B (i.e., the second position) is set on a position closer to the center print region relative to the first position.

As shown in FIG. 11, a positional relationship between position A (the first position) and position B (the second position) is determined such that an overlap exists between the nozzle orifices for ejecting yellow ink, cyan ink, and magenta ink when the recording head 5 is located at position A (the first position) and the nozzle orifices for ejecting black ink when the recording head 5 is located at position B (the second position).

When the carriage 1 arrives at position B (the second position), the carriage position controller 37 sends a control signal to the flushing controller 32, whereupon the nozzle orifices 5*a* assigned to black ink eject black ink.

At this time, the remaining colors of ink are not ejected from the nozzle orifices 5*b*, 5*c*, and 5*d* assigned to yellow ink, cyan ink, and magenta ink, respectively.

Consequently, the black ink ejected from the nozzle orifices 5*a* adhere to the slant surface 20*a*.

The yellow ink, cyan ink, and magenta ink which are ejected at position A (the first position) and partially remain on the slant surface 20*a* are mixed with the black ink, flow downward over the slant surface 20*a*, and are absorbed by the ink-absorbing member 14.

Alternatively, the other colors of ink; i.e., yellow ink, cyan ink, and magenta ink, become dissolved after ejecting of black ink, whereby the black ink flows over the slant surface 20*a* and is absorbed by the ink-absorbing member 14.

As mentioned above, since a specific positional relationship exists between position A (the first position) and position B (the second position), other colors of ink can adhere to the position where black ink is to adhere, thus preventing solidification of the black ink.

In the previous embodiments, position A (the first position) and position B (the second position) are set in pre-determined locations. However, the present invention is not limited to such embodiments. As shown in FIG. 13B, position B (the second position) may be set to a fixed position, and position A (the first position) may be changed whenever necessary, such that the distance X between position A (the first position) and position B (the second position) is limited within the domain of $L1-L2 \leqq X \leqq L1+L2$ or $2(L1-L2) \leqq X \leqq 2(L1+L2)$.

Conversely, position B (the second position) may be changed, whenever necessary.

Particularly, in a case where position A (the first position) can be changed whenever necessary, position A (the first position) is desirably prevented from being set in the same location, by changing the location every time ink is ejected at position A (the first position). In this case, yellow ink, cyan ink, and magenta ink are ejected over a wide range and are mixed with black ink to be subsequently ejected over a wide range, thus preventing solidification of black ink. The thus-mixed colors of ink flow down over the slant surface 20*a* and are absorbed by the ink-absorbing member 14.

Alternatively, position A (the first position) may be set to a fixed position, and position B (the second position) may be changed whenever necessary, such that the distance X between position A (the first position) and position B (the second position) is limited within the domain of $L1-L2 \leqq X \leqq L1+L2$ or $2(L1-L2) \leqq X \leqq 2(L1+L2)$.

Even in this case, if the black ink to be ejected at position A (the first position) becomes solidified, position A (the first position) is shifted, and black ink is prevented from being cumulatively deposited on a single location on the slant surface 20*a*.

In the previous embodiments, the first ink is to be ejected when the carriage is stopped at position A (the first position) of the recording head. However, the present invention is not limited to such a configuration. The first ink may be ejected at the instant at which the carriage begins to accelerate.

Alternatively, other colors of ink; i.e., yellow, cyan, and magenta, may be ejected when the carriage has arrived at position A (the first position), without the carriage being stopped.

Further, in the previous embodiments, black ink is ejected when the carriage arrives at position B (the second position) and while the carriage is stopped. However, the present invention is not limited to such a configuration. Black ink may be ejected at the instant when the carriage being to accelerate from a stationary state.

Moreover, black ink may be ejected when the carriage has arrived at position B (the second position) without the carriage being stopped.

As mentioned above, since black ink is ejected while the carriage is in motion, the black ink is prevented from being deposited on the same location on the slant surface 20.

Although in the previous embodiments various flushing methods are to be performed within the respective flushing regions 13A and 13B, the flushing method to be performed within the flushing region 13B may be identical with or differ from that to be performed in the flushing region 13A.

Within the flushing region 13A, the ink to be ejected at position A (the first position) and the ink to be ejected at position B (the second position) may be the reverse of those ejected in the previous embodiments. More specifically, when the carriage arrives at position A (the first position), black ink is ejected without the carriage being stopped. When the carriage arrives at position B (second position), the carriage may be stopped and the yellow, cyan, and magenta colors of ink may be ejected.

Flushing operations other than the foregoing flushing methods, such as those previously, described may also be applied to the flushing operation.

The manner of ejecting ink without the carriage being stopped has been described in connection with description of the flushing method. This manner is preferable in terms of an improvement in throughput.

As is evident from the foregoing description, the ink-jet recording apparatus of the firth embodiment yields the advantage of preventing solidification of the ink ejected from the recording head and ensuring absorption of ink by the ink-absorbing member.

Further, the ink-jet recording apparatus of the present invention yields the advantage of receiving the ink ejected from the recording head without a necessity for placing the ink-absorbing member at positions where it faces the flushing regions and guiding the thus-ejected ink to the ink-absorbing member without solidification of the ink on the slant member.

In the previous embodiments, the apertures 13*a* and 13*b* are formed in the paper guide member 8 so as to become larger than the nozzle orifices with respect to the traveling direction of the carriage. However, since ink drops are not ejected from all the nozzle orifices at position A (the first position) and position B (the second position), taking a suitable flushing method, the ink passes through the apertures 13*a* and 13*b* without splashing onto the surroundings even if the length Z of the apertures 13*a* and 13*b* formed in the paper guide member 8 within the respective flushing regions 13A and 13B with respect to the traveling direction of the carriage is smaller than the length Y of the nozzle plate as shown in FIG. 14.

As an example of such a case, an ink-jet recording apparatus according to a sixth embodiment of the present invention will now be described by reference to FIGS. 6, 8 and 15 through 18.

FIGS. 6 and 8 used in connection with the description of the ink-jet recording apparatus of the third embodiment are referred to, exactly as they are, for describing the ink-jet recording apparatus according to the sixth embodiment.

Figure 15:
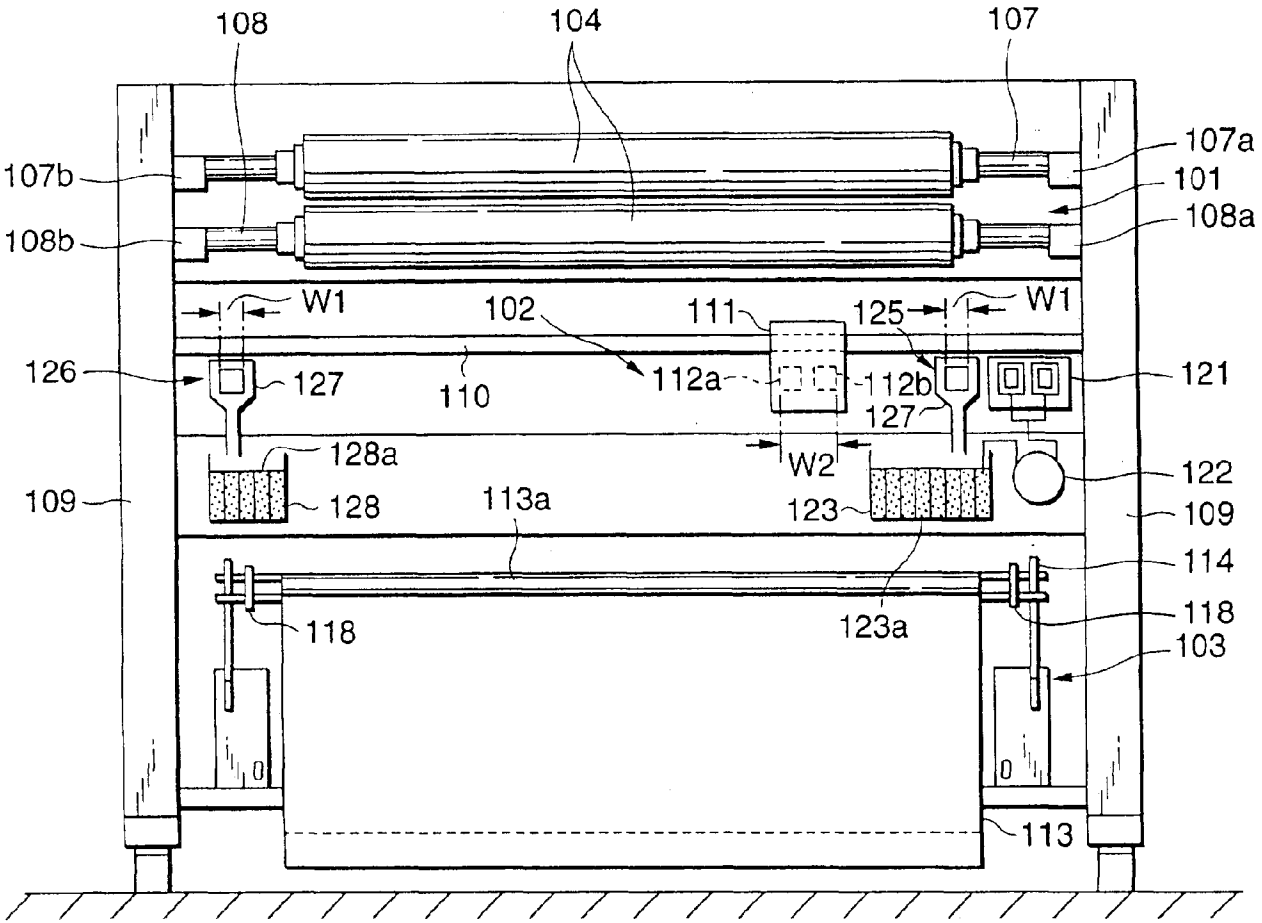
FIG. 15 is a front view showing the interior configuration of an ink-jet recording apparatus according to the sixth embodiment of the present invention.

Other than FIG. 15, which shows the configuration of an ink receiver unit characterizing the sixth embodiment, explanations of the configuration, elements, and reference numerals provided in FIGS. 6 and 8 are omitted here for brevity.

FIG. 15 is different from FIG. 7 in connection with the following points.

A plurality of recording heads 112*a* and 112*b* are mounted side-by-side on the carriage 111 with respect to the traveling direction of the carriage 111.

One end of the area over which the recording heads 112*a* and 112*b* mounted on the carriage 111 travel corresponds to a non-print region (the home position), where capping member 121 is disposed.

The recording heads 112*a* and 112*b* are mounted on the carriage 111 such that nozzle forming surfaces of the recording heads 112*a* and 112*b* are slightly tilted relative to the perpendicular. The capping member 121 comprises two cap members which are arranged so as to correspond to and be able to seal the respective nozzle forming surfaces of the recording heads 112*a* and 112*b* when the recording heads 112*a* and 112*b* move to the non-print position.

A suction pump 122 for imparting negative pressure to the interior space of the capping member 121 is provided below the capping member 121.

The capping member 121 acts as a cap member for preventing drying of the nozzle orifices of the recording heads 112*a* and 112*b* while the printer is in an idle mode. Further, the capping member 121 acts as head cleaning means for sucking ink by imparting negative pressure generated by the suction pump 122 to the recording heads 112*a* and 112*b*.

Ink receiver units 127 disposed in the respective flushing regions 125 and 126 are formed so as to become substantially identical in configuration. The width W1 of the ink receiver unit 127 in the traveling direction of the carriage is set so as to become smaller than the total width W2 of the first and second recording heads 112*a* and 112*b* in the traveling direction of the carriage.

More specifically, the ink receiver unit 127 is formed such that the width W1 of the ink receiver unit 127 becomes slightly larger than the width of each of the first and second recording heads 112*a* and 112*b*.

Since any other configuration, elements, and reference numerals are identical with those shown in FIG. 7, repetition of their explanations is omitted here for brevity.

Figure 16:
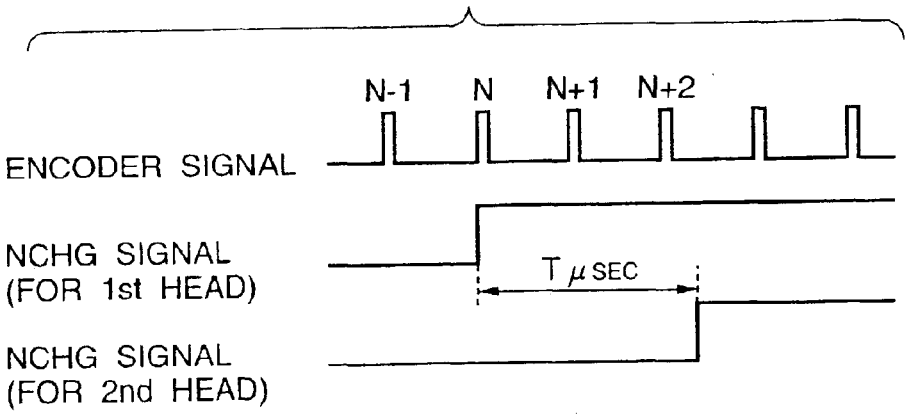
FIG. 16 is a timing chart for describing the operation of the flushing position controller installed in the ink-jet recording apparatus of FIG. 15.
Figure 17:
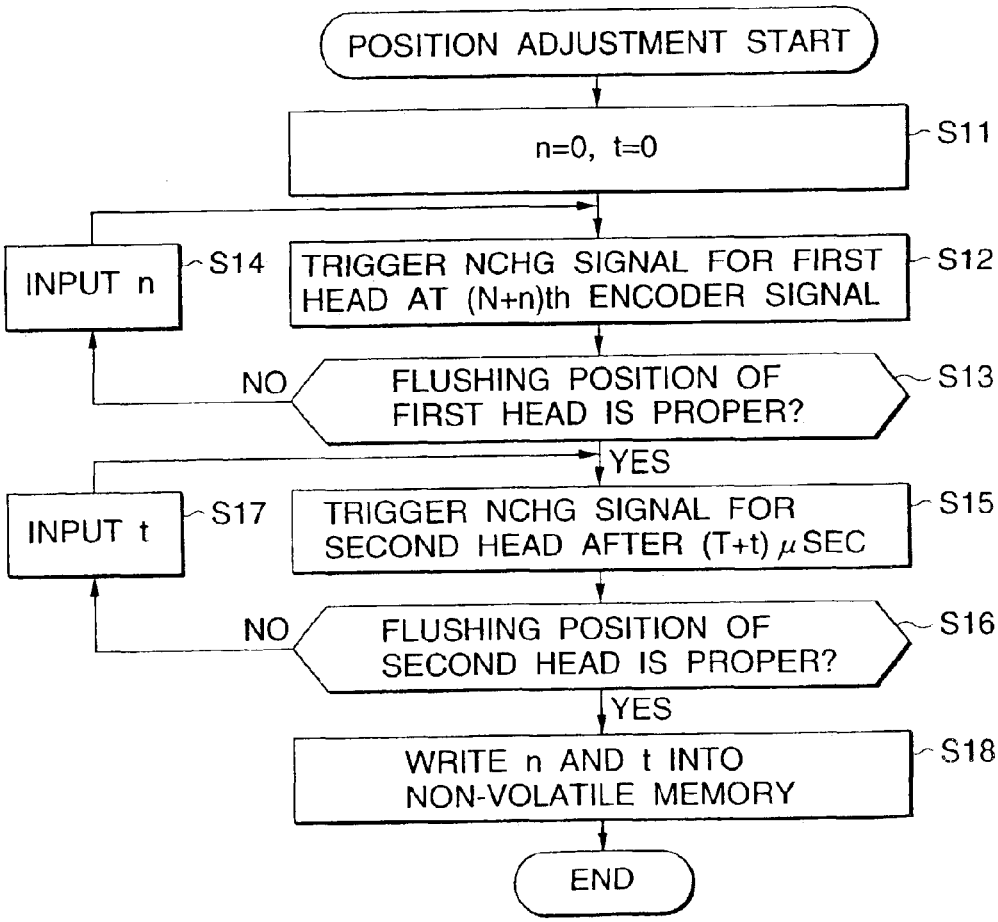
FIG. 17 is a flowchart showing the control operation of the flushing position controller installed in the ink-jet recording apparatus of FIG. 15.
Figure 18:
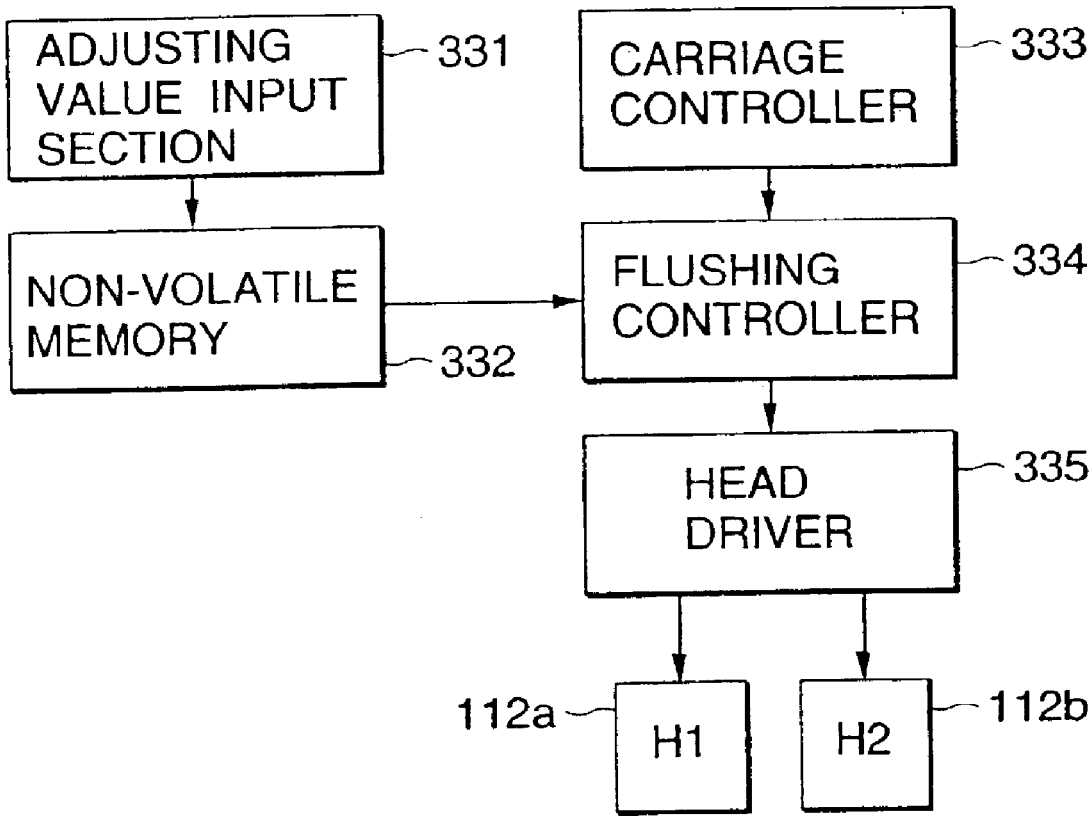
FIG. 18 is a block diagram showing the configuration of the flushing position controller installed in the ink-jet recording apparatus of FIG. 15.

FIGS. 16 through 18 show the operation and configuration of the flushing position controller incorporated in the ink-jet recording apparatus of this embodiment.

The ink receiver units 127 disposed in the respective first and second flushing regions 125 and 126 are formed such that the width W1 of the ink receiver unit 127 in the traveling direction of the carriage becomes smaller than the total width W2 of the first and second recording heads 112*a* and 112*b* in the traveling direction of the carriage.

The recording heads 112*a* and 112*b* are controlled so as to be flushed at respective predetermined timings while the carriage is in motion. Even in the case of the foregoing relationship existing between the width W1 of the ink receiver unit 127 and the total width W2 of the first and second recording heads 112*a* and 112*b*, the ink droplets ejected for flushing purpose can be captured by the corresponding ink receiver units 127 without fail.

In order to effect such operation of the flushing position controller, the timings at which flushing control signals are output to the first and second recording heads 112*a* and 112*b* must be controlled.

FIG. 16 is a timing chart relating to a control method for use with the flushing position controller.

As shown in FIG. 16, a linear encoder signal is utilized as a reference position which is set beforehand and corresponds to the flushing region.

The linear encoder signal is produced when a sensor disposed on the carriage reads a mark or a magnetic scale provided in a strip pattern in the traveling direction of the carriage.

For convenience of explanation, the linear encoder signal shown in FIG. 16 is assigned reference symbols, such as N−1, N, N+1, and N+2.

A nozzle charge (NCHG) signal is delivered to each of the first and second recording heads. When the NCHG signal is high (hereinafter also called simply "H"), the recording head is brought into a flushing state in which all of the nozzles of each head eject ink.

At the time of adjustment of the position where the first recording head is to be flushed, the N-th encoder signal counted from the home position is utilized as a reference position. An NCHG signal for the first recording head is temporarily become high at the N-th encoder signal.

At the time of adjustment of the position where the second recording head is to be flushed, the N-th encoder signal counted from the home position is utilized as a reference signal, as in the case of the first recording head. An NCHG signal for the second recording head is temporarily set to become high at a timing which lags T ($\mu$sec) from the reference position.

These two temporal flushing positions are taken as design references of the recording apparatus.

FIG. 17 shows operation procedures relating to a sequence for inputting an adjusting value for accurately determining flushing positions where ink droplets are reliably ejected to the opening of each of the ink receiver units 127 while the recording heads are in motion, by addition of correction values to the temporal flushing positions described in connection with FIG. 16.

The adjusting value is input at the time of, for example, shipping products from the factory, or may be performed by the end user.

First, in step S11 shown in FIG. 17, n=0 and t=0 are set.

Here, "n" designates a correction value to be used for correcting the reference position N of the encoder signal and is managed by the number of pulses.

Further, "t" designates a correction value to be used for correcting the timing which lags delay time T behind the reference position N of the encoder signal. Therefore, "t" is managed as a delay time.

As mentioned above, numerical values of these elements "n" and "t" are set to 0 at the beginning.

Subsequently, processing proceeds to step S12. In this state, since n=0, the NCHG signal for the first recording head becomes high at the timing of N-th encoder signal (design reference).

Flushing is effected in step S13, and a determination is made as to whether or not the flushing position for the first recording head is appropriate.

In step S13, if the flushing position for the first recording head is determined to be appropriate (YES is selected), processing proceed to step S15. In contrast, if the flushing position is determined to be inappropriate (NO is selected), a numerical value is input to "n" in step S14.

On the basis of a result of flushing performed in step S13, the operator inputs an appropriate value for "n" determined on the basis of a certain degree of experience and instinct. Processing then returns to step S12, where the NCHG signal for the first recording head is set so as to become high at the (N+n)-th encoder signal.

Therefore, "n" may assume a positive or negative value.

After the adjustment of "n," flushing is again effected in step S13, and a determination is made as to whether or not the flushing position for the first recording head is appropriate.

If in step S13 the flushing position for the first recording head is determined to be appropriate (YES is selected), processing then returns to step S15, where the flushing position for the second recording head is adjusted.

As mentioned above, since t=0, in step S15 the NCHG signal for the second recording head is set so as to become high at a timing which lags T $\mu$sec behind the reference position (i.e., design reference).

In step S16, flushing is effected, and a determination is made as to whether or not the flushing position for the second recording head is appropriate.

In step S16, if the flushing position is determined to be appropriate (YES is selected), processing proceeds to step S18. In contrast, if the flushing position is determined to be inappropriate (NO is selected), a value is input to "t" in step S17.

Even in the case of "t," on the basis of a result of flushing performed in step S16, the operator inputs an appropriate value for "t" determined on the basis of a certain degree of experience and instinct. Processing then returns to step S15, where the NCHG signal for the second recording head is set so as to become high at a position which lags (T+t) $\mu$sec behind the reference position.

Therefore, "t" may also assume a positive or negative value.

After the adjustment of "t," flushing is again effected in step S16, and a determination is made as to whether or not the flushing position for the second recording head is appropriate.

If in step S16 the flushing position for the second recording head is determined to be appropriate (YES is selected), processing then returns to step S18, where the value of "n" set in step S14 and the value of "t" set in step S17 are written into non-volatile memory. The operations for inputting adjusting values are now completed.

As can be understood from the foregoing description, the values of "n" and "t" written in the non-volatile memory correspond to reference values plus the time of flight of ink droplets ejected for flushing. Flushing positions can be accurately determined through use of a control system, which will be described below.

FIG. 18 is a block diagram showing a control system for effecting appropriate flushing operation on the basis of the correction value input by way of the previously-described adjusting value input sequence.

In the drawing, reference numeral 331 designates an adjusting value input section for executing the adjusting value input sequence described in connection with FIG. 17.

Reference numeral 332 designates a non-volatile memory in which the correction values of "n" and "t" input by way of the adjusting value input section 331 are stored.

An encoder signal, which is produced in association with the carriage being moved by a carriage controller 333, is input to a flushing controller 334. The corrected values relating to "n" and "t" are supplied to the flushing controller 334 from the non-volatile memory 332.

The flushing controller 334 produces a flushing control signal for the first recording head at a timing corresponding to the value of N+n, and a flushing control signal for the second recording head at a timing corresponding to the value of T+t.

The flushing control signal corresponding to the value of N+n is supplied to a head driver 335, and a drive signal for flushing a first recording head 112*a* is produced.

Similarly, the flushing control signal corresponding to the value of T+t is also supplied to the head driver 335, and a drive signal for flushing a second recording head 112*b* is produced.

The respective recording heads 112*a* and 112*b* are flushed at the positions opposite the openings of the ink receiver units 127 while the carriage is in motion.

The ink receiver units 127 capture ink droplets ejected from the recording heads for flushing without fail when the carriage passes very closely by the ink receiver units 127, and the thus-captured waste ink can be discharged to the waste-ink tanks.

The foregoing description has described the adjustment of the flushing positions within the first flushing region 125 close to the home position. Adjustment of flushing positions within the second flushing region can be effected by taking, as a reference position, the position pertaining to an encoder signal which is a design reference position for the second flushing region 126; i.e., N+xxxx, and by performing operations similar to those mentioned previously.

In the foregoing description, the correction value to be used for correcting the reference flushing position of the first recording head is managed by means of the number of pulses, and the correction value to be used for correcting the reference flushing position of the second recording head is managed by means of the delay time. However, the correction values to be used for correcting the reference flushing positions of the first and second recording heads may be managed by means of the number of pulses.

Although the previous embodiment illustrates the recording apparatus equipped with two recording heads, the flushing positions of recording heads may be determined by means similar to those mentioned previously, even in the case of a recording apparatus equipped with three or more recording heads.

The foregoing description has described the example in which the present invention is applied to a particularly large-sized recording apparatus, such as one of those shown in FIGS. 6, 8, and 15. However, the present invention is not limited to such a specific type of recording apparatus. As a matter of course, the present invention can be applied to another type of ink-jet recording apparatus and yield the same working-effect.

As is evident from the foregoing descriptions, the flushing controller in the ink-jet recording apparatus of the sixth embodiment comprises the adjusting value input section for controlling the timings at which flushing control signals are to be output to the respective recording heads. The timings at which the flushing control signals are to be output to the respective recording heads are determined by utilization of the adjusting values input by way of the adjusting value input section. Therefore, ink droplets can be accurately ejected within the flushing regions while the recording heads are in motion, thus enabling an improvement in flushing throughput. Further, since the area where ink droplets are to be shot can be specified to a narrower area within the flushing regions, the width of the flushing regions can also be reduced, thus contributing to rendering the recording apparatus compact.

In the above embodiments, the timing of flushing operation is managed with respect to each of the recording heads as a minimum unit. However, according to the present invention, the timing may be managed with respect to each of rows of the nozzle orifices provided in a single recording head as a minimum unit. Such an example will be discussed below as a seventh embodiment of the invention.

In this embodiment, as shown in FIG. 19, a carriage 417 is connected to a stepping motor 419 by a timing belt 418 and is guided by a guide bar 420 so as to reciprocate in the paper width direction of record paper 421 (main scanning direction). The recording head 416 is attached to the face of the carriage 417 opposed to the record paper 421 (in the example, lower face). Ink is supplied from the ink cartridge 415 to the recording head 416 and ink drops are jetted on the top of the record paper 421 for printing an image or text on the record paper 421 as a dot matrix while the carriage 417 is moved.

A flushing box (ink receptacle) 422, a vessel for receiving ink drops jetted from the recording head 416 by flushing, is placed in a non-print area in the move range of the carriage 417. A cap 423 for sealing the nozzle orifices of the recording head 416 while printing stops, thereby preventing the nozzle orifices from drying as much as possible is placed outside the flushing box 422 so as to be contiguous with the flushing box 422. The cap 423 is connected to a suction pump 424 (see FIG. 20) for giving negative pressure to the nozzle orifices of the recording head 416 at the cleaning time and sucking ink from the nozzle orifices.

The recording head 416 is mounted on the carriage 417 and as shown in FIG. 19, starts to move from the stop state in the non-print area in the move range, is accelerated, and is moved with constant velocity in a print area on the record paper 421 for printing. The flushing box 422 is placed in the area containing the acceleration area in which the carriage 417 is accelerated.

Figure 20:
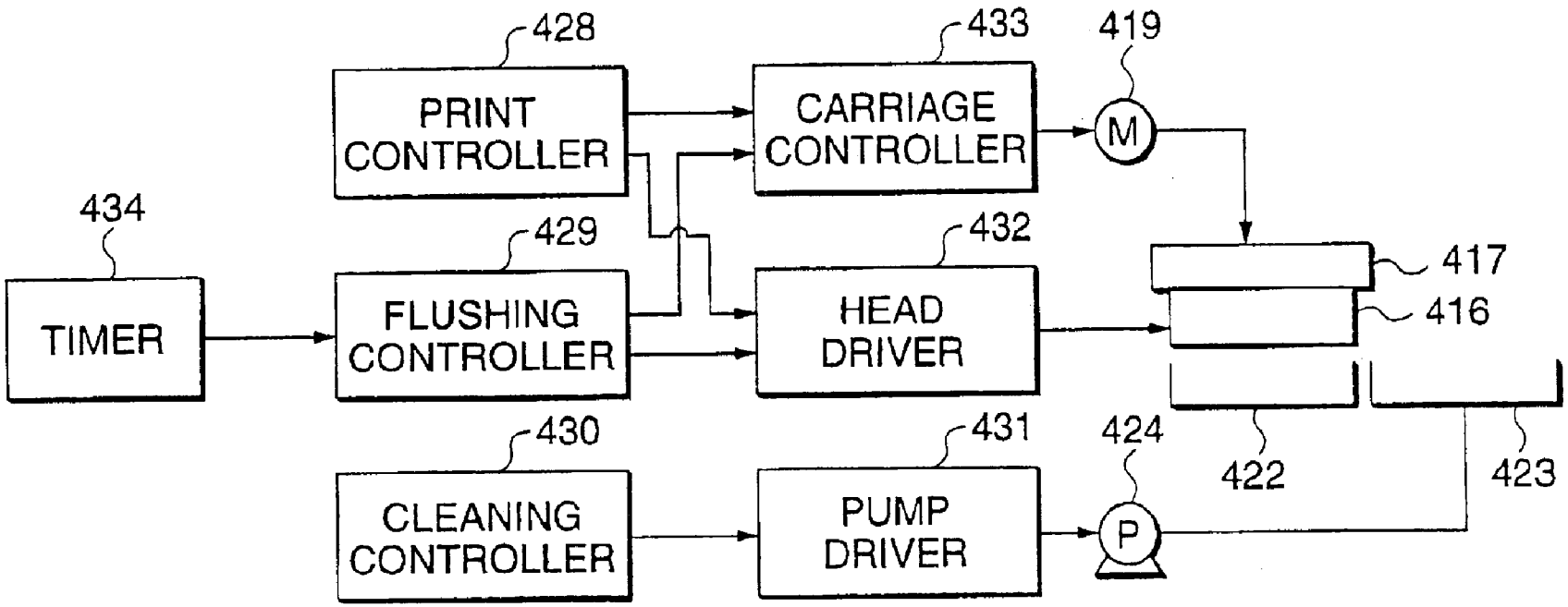
FIG. 20 is a schematic representation to show the configuration of the ink jet recording apparatus of FIG. 19.

As shown in FIG. 20, the recording apparatus comprises a print controller 428 for creating bit map data based on a print signal from a host, carriage controller 433 for controlling the stepping motor 419 for controlling a move of the carriage 417 in the main scanning direction, and a head driver 32 for driving the recording head 416 based on a signal from the print controller 428 for jetting ink drops therefrom.

The recording apparatus also comprises a flushing controller 29 for moving the carriage 417 to a position where the recording head 416 faces the flushing box 422 and driving the recording head 416 independently of print data for controlling flushing. The flushing controller 429 controls the flushing jet interval based on a timer 434. In the figure, a numeral 430 denotes a cleaning controller for controlling a pump driver 31 for controlling cleaning.

Figure 21:
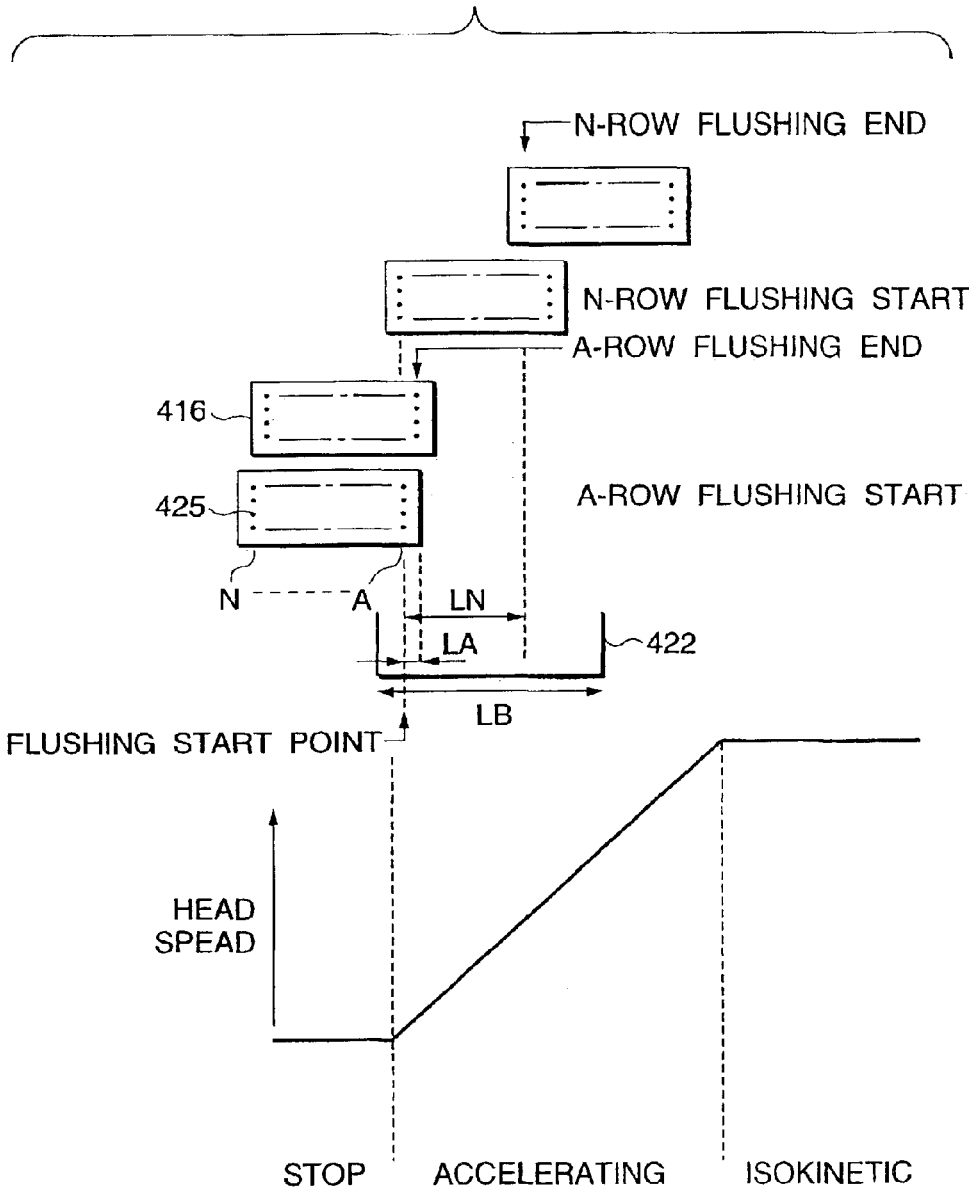
FIG. 21 is a schematic representation to show the operation of the ink jet recording apparatus of FIG. 19.

As shown in FIG. 21, the recording apparatus uses the recording head 416 formed with a plurality of nozzle rows 425 each consisting of a plurality of nozzle orifices 408, and the nozzle orifices are arranged as A to N rows in the move direction of the carriage 417.

In the recording apparatus, flushing is not executed in the stop state of the carriage 417 and after the carriage 417 starts to move, flushing is executed in the acceleration area of the carriage 417. When each of the A to N rows of the nozzle rows reaches a given flushing start point, flushing is started in order for each nozzle row 425 and a predetermined amount of ink drops is jetted.

At this time, the carriage 417 continues to accelerate while flushing is executed on the A to N rows in order, the distance (LN) of moving the recording head 416 from flushing start to end of the nozzle row (N row) on the opposite side to the side where the carriage 417 starts to move becomes longer than the distance (LA) of moving the recording head 416 from flushing start to end of the nozzle row (A row) on the side where the carriage 417 starts to move.

Therefore, in the example, the nozzle rows 425 on the side of the N row positioned in the opposite direction to the direction in which the carriage 417 starts to move jet ink of the type with a smaller number of flushing jet ink drops. For example, to use inks of six colors of black (K), cyan (C), magenta (M), yellow (Y), light magenta (LM), and light cyan (LC), the number of flushing jet ink drops can be lessened in the order of LM<LC<Y<M≅C<K and thus the nozzle rows 425 may be placed from the N row side. In doing so, on the nozzle rows 425 on the N row side, the distance of moving the recording head 416 from flushing start to end is shortened and the flushing box 422 can be miniaturized accordingly.

In the recording apparatus, the length dimension (LB) of the flushing box 422 in the move direction of the carriage 417 is set equal to or more than a value L determined according to the relational expression shown below from carriage acceleration (a), the number of flushing jet ink drops (Fc), flushing frequency (Ff), and the distance (lo) between the nozzle rows of the A and N rows at both ends of the recording head 416. In the expression, Vo is the head speed and t is the flushing time. Thus, the necessary ink receptacle size can be provided, the ink receptacle can be made smaller than that of the recording apparatus in the related art, and the throughput can also be enhanced.

$$L = Vo \cdot t + \frac{1}{2}at^2$$

$$= \sqrt{2}\, a \cdot lo \frac{Fc}{Ff} + \frac{1}{2}a\left(\frac{Fc}{Ff}\right)^2$$

In the recording apparatus, flushing is executed while the recording head 416 is being moved, so that the length (LB) of the flushing box 422 in the move direction of the recording head 416 can be made shorter than the distance between the nozzle rows of the A and N rows at both ends of the recording head 416. Therefore, the recording apparatus itself can be miniaturized accordingly. Since flushing is executed while the recording head 416 is being moved, the throughput loss is lessened accordingly.

In the recording apparatus, when the recording head 416 arrives at the given flushing start point for each of the nozzle rows 425, flushing is started in order. Thus, at the flushing time, each nozzle row 425 starts to jet at the same position, so that the area where ink drops are jetted by the flushing is narrowed and the flushing box 422 can be miniaturized drastically.

Moreover, in the recording apparatus, the flushing jet intervals are controlled based on the timer and thus if flushing is executed while the recording head is being accelerated, the jet period does not change unlike the case where the timing of an encoder or the like is adopted.

Figure 22:
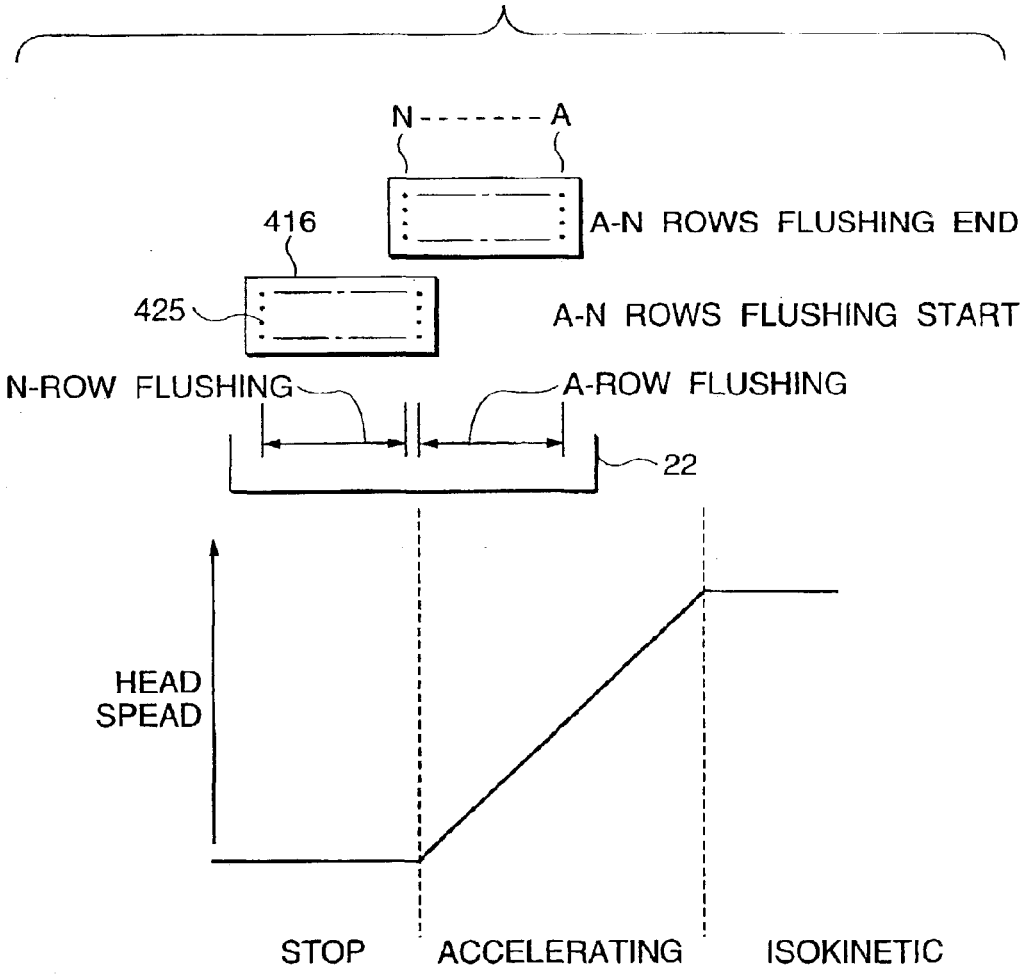
FIG. 22 is a schematic representation to show the operation of an ink jet recording apparatus according to an eighth embodiment of the invention.
Figure 23:
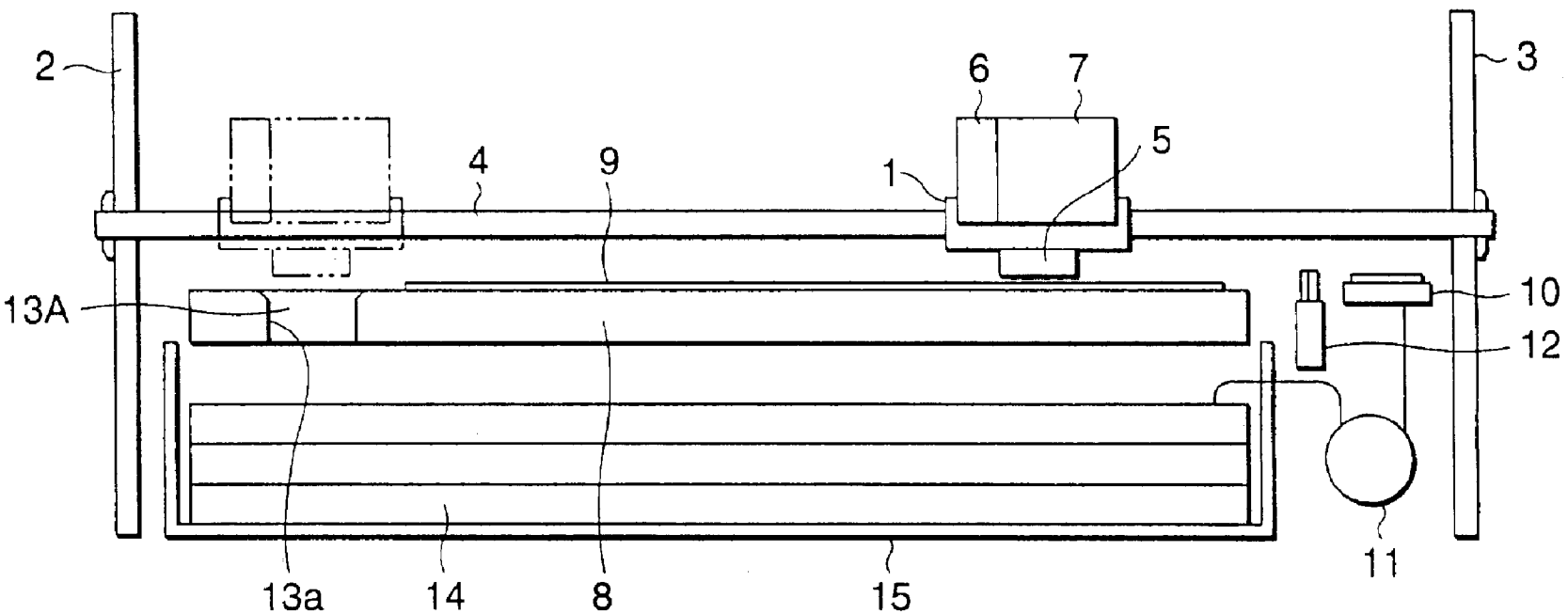
FIG. 23 is a front view showing a main unit of a related ink-jet recording apparatus, with a portion of the main unit being shown in cross section.

FIG. 22 shows an eighth embodiment of ink jet recording apparatus of the invention. In the recording apparatus, moving a carriage 417 is started at the same as flushing is started simultaneously on all nozzle rows 425. The nozzle rows 425 on the side of A row positioned in the direction in which the carriage 417 starts to move jet ink of the type with a smaller number of flushing jet ink drops. Other matters are similar to the seventh embodiment and similar parts are denoted by the same reference numerals.

In the recording apparatus, flushing is executed while a recording head 416 is moved and accelerated, so that the throughput is enhanced and unbalanced distribution of ink jetted into a flushing box 422 is lessened. If the nozzle rows 425 on the side of the A row continue to jet while being accelerated, the flushing box 422 is enlarged accordingly. Thus, the number of flushing jet ink drops is lessened on the nozzle rows 425 on the A row side, whereby the area where ink drops are jetted by the flushing is narrowed and the flushing box 422 can be miniaturized accordingly. Other advantages are similar to those of the seventh embodiment.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink-jet recording apparatus comprising:

a carriage equipped with an ink-jet recording head; and said ink-jet recording head mounted on the carriage, the head configured to record an image on a recording medium by ejecting droplets, wherein a first liquid is ejected from the head and a second liquid is ejected from the head, and wherein the second liquid prevents solidification of the first liquid by dissolving the first liquid.

2. The ink-jet recording apparatus of claim 1, wherein the first liquid is the same color as the second liquid.

3. The ink-jet recording apparatus of claim 2, wherein the first liquid and the second liquid both have black ink.

4. The ink-jet recording apparatus of claim 1, wherein the first liquid is a different color from the second liquid.

5. The ink-jet recording apparatus of claim 4, wherein the first liquid is different from the second liquid in viscosity.

6. The ink-jet recording apparatus of claim 4, wherein a viscosity of the first liquid is greater than that of the second liquid.

7. The ink-jet recording apparatus of claim 1, wherein said first liquid comprises black ink, and said second liquid consists of at least one ink selected from the group consisting of yellow, cyan, and magenta.

8. The ink-jet recording apparatus of claim 1, wherein said second liquid is ejected while said carriage is in motion.

9. The ink-jet recording apparatus of claim 1, wherein the first liquid is capable of becoming more solidified than the second liquid.

10. An ink-jet recording apparatus comprising:

a carriage equipped with an ink-jet recording head; wherein said ink-jet recording head is mounted on the carriage, and is capable of forming an image on a recording medium by ejecting droplets, a first liquid is ejected from the head; and a second liquid prevents solidification of the first liquid.

* * * * *